US005525081A

United States Patent [19]

Mardesich et al.

[11] Patent Number: 5,525,081

[45] Date of Patent: Jun. 11, 1996

[54] TRANSDUCER SYSTEM FOR TROLLING MOTOR

[75] Inventors: Joseph L. Mardesich; Richard J. Stevens, both of San Jose, Calif.

[73] Assignee: Pinpoint Corporation, San Jose, Calif.

[21] Appl. No.: 277,874

[22] Filed: Jul. 20, 1994

[51] Int. Cl.[6] ..... B60L 11/02

[52] U.S. Cl. ..... 440/6; 114/144 E; 440/1

[58] Field of Search ..... 114/144 B, 144 E; 318/588; 440/1, 6

[56] References Cited

U.S. PATENT DOCUMENTS

| | | | |
|---|---|---|---|
| 5,041,029 | 8/1991 | Kulpa | 114/144 B |
| 5,129,345 | 7/1992 | Sentfen | 114/144 E |
| 5,362,263 | 11/1994 | Petty | 114/144 E |

*Primary Examiner*—Jesus D. Sotelo
*Attorney, Agent, or Firm*—Claude A. S. Hamrick; Emil C. Chang

[57] ABSTRACT

A trolling motor system and method for controlling the trolling motor, including a microcontroller, a plurality of transducers, a steering motor, and an outboard motor. The user is allowed to input commands via a keypad and the selected mode of operation is displayed via an LCD screen. The microcontroller operates the transducer to transmit sonar signals and the return signals are received and processed accordingly. In the preferred embodiment, there are five transducers arranged in a manner such that the port (left side of the boat) and starboard (right side of the boat) sides as well as the bottom of the boat are scanned continuously.

The microcontroller processes the signals according to the user-selected mode, determines the steering degree and the motor speed, transmits these values to the Steering Motor And Position controller and the Power Drive And Motor controller. In the preferred embodiment there are three automatic modes of operation: creek-tracking mode, depth-tracking mode, and shore-tracking mode.

38 Claims, 23 Drawing Sheets

TRANSDUCER SYSTEM FOR TROLLING MOTOR

BACKGROUND OF THE INVENTION

1. Field of the Invention

This invention relates generally to a method and system for controlling trolling motors used by fishermen, and more particularly to a microcontroller-based trolling motor system operating a plurality of transducers organized to transmit and receive sonar signals in order to set the direction and speed of the trolling motor and cause it to follow a user-specified depth contour of the underwater bottom terrain, or to maintain a user-specified distance from the shore, or to find the deepest area of the underwater bottom terrain.

2. Brief Description of the Prior Art

In fishing, once the angler runs the boat to the desired vicinity, the boat is operated by a smaller outboard motor, a "trolling motor", powered by a battery to provide maneuverability and to minimize disturbance to the fishing environment.

The angler, knowing the temperature of the water, can determine the depth at which the object fish prefers to swim. The angler would then wish to maintain the boat over this depth and fish at this depth. In another scenario, the angler may simply wish to fish at the deepest part of a creek that may or may not be at the middle of the creek. Furthermore, in another scenario, the angler may wish to fish at a relatively fixed distance from the shore.

In two of the three scenarios mentioned above or variations thereof, the angler would have to manually activate the sonar to find the depth of the current boat location, steer the boat in one direction, read the sonar again to see if the boat is being steered in the correct direction for the desired depth, and adjust the steering again if necessary. This process is repeated continuously until the angler is content with the location of the boat. If there is a drift current or strong wind, the boat would be pushed downwind or downstream and the angler would have to account for the drift current and constantly readjust and operate the boat. In all three scenarios, between monitoring the sonar and operating the motor, the angler has very little time left for fishing.

Thus, it is desirable to have an automated system whereby the angler sets the desirable mode once, is free from operating the sonar and the motor, and is allowed to spend most of his or her time on fishing.

Transducer systems operating in conjunction with microcontroller have been used in fish finder systems and bottom detection systems. However, there are no known microcontroller based systems operating transducers and a motor similar to the invention disclosed herein.

SUMMARY OF THE INVENTION

The present invention utilizes a microcontroller, a plurality of transducers, a steering motor, and an outboard motor. The user is allowed to input commands via a keypad and the selected mode of operation is displayed via a LCD screen. The microcontroller operates the transducer to transmit sonar signals, and the return signals are received and processed accordingly. In the preferred embodiment, there are five transducers arranged in a manner such that the port (left side of the boat) and starboard (right side of the boat) sides, as well as the bottom of the boat, may be scanned continuously.

The microcontroller processes the signals according to the user-selected mode, determines the steering degree and the motor speed, and transmits these values to the Steering Motor and Position controller and the Power Drive and Motor controller.

In the preferred embodiment, there are three automatic modes of operation: creek-tracking mode, depth-tracking mode, and shore-tracking mode. In the creek-tracking mode, the microcontroller finds the deepest area in a creek or channel and maintains the boat on that course; in the depth-tracking mode, the microcontroller maintains the boat on a certain contour of the bottom terrain; and in the shore-tracking mode, the microcontroller maintains the boat at a desired distance from the shore. In each of these modes, the user may increase or decrease the speed of the boat and has the option to do an automatic U-turn of the boat. There is also a manual mode where the user controls the direction and speed of the boat.

Once one of the automatic modes is selected, the microcontroller operates the troller and the angler can concentrate on fishing and does not need to be concerned with operating the boat.

Accordingly, it is an object of the present invention to provide an improved method and apparatus for depth tracking using transducers.

It is another object of the present invention to provide an improved method and apparatus for shore tracking using transducers.

It is another object of the present invention to provide an improved method and apparatus for tracking deepest terrain of an underwater surface.

It is another object of the present invention to provide for an improved method and apparatus to provide an automated transducer troller system that frees anglers from constantly operating the boat.

It is another object of the present invention to provide for an improved method and apparatus to allow automatic U-turns.

These and other objects and advantages of the present invention will no doubt become apparent to those skilled in the art after having read the following detailed description of the preferred embodiment which is illustrated in the several figures of the drawing.

IN THE DRAWING

Figures 5A, 5B:
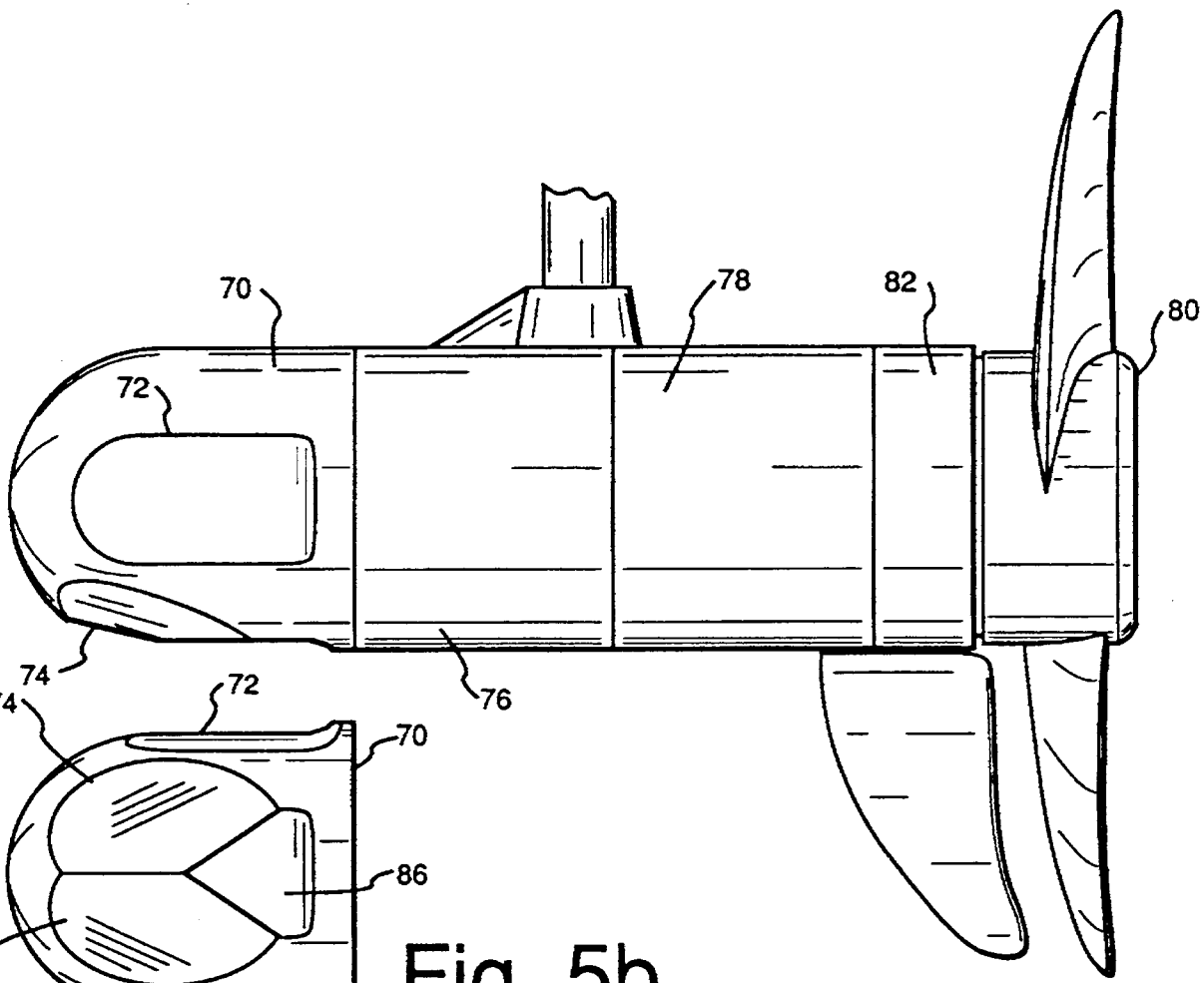

FIG. 5*a* is a side view of the trolling motor, detailing the transducers.

FIG. 5*b* is a bottom view of the nose cone of the trolling motor showing the layout of the transducers.

Figure 6B:
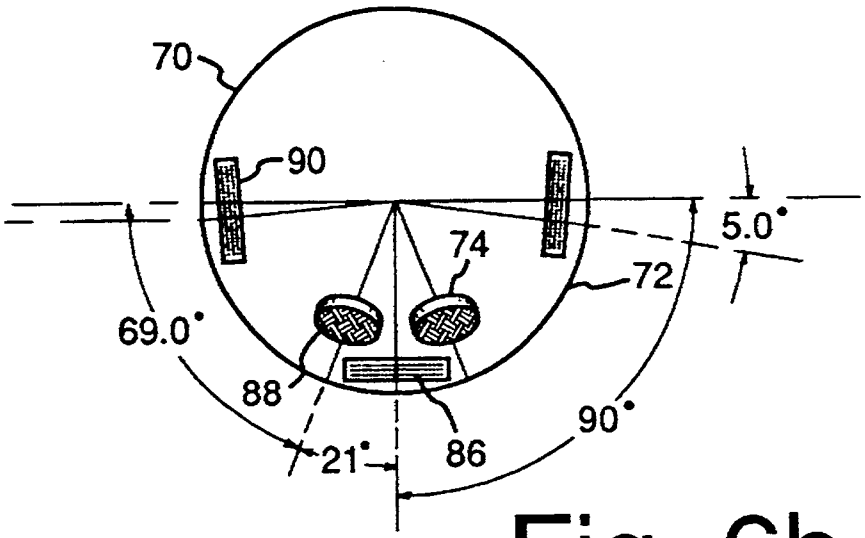
Figure 6A:
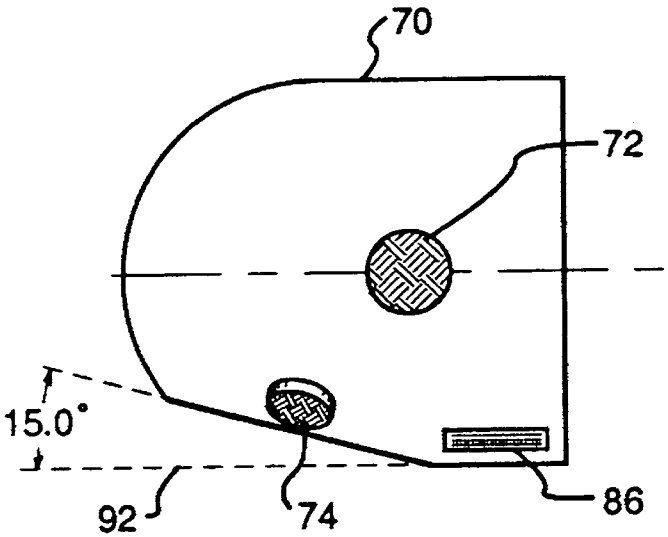

FIG. 6*a* is a side view of the nose cone showing the geometric relationship of the transducers' placements.

FIG. 6*b* is a front view of the nose cone showing the geometric relationship of the transducers' placements.

Figure 7:
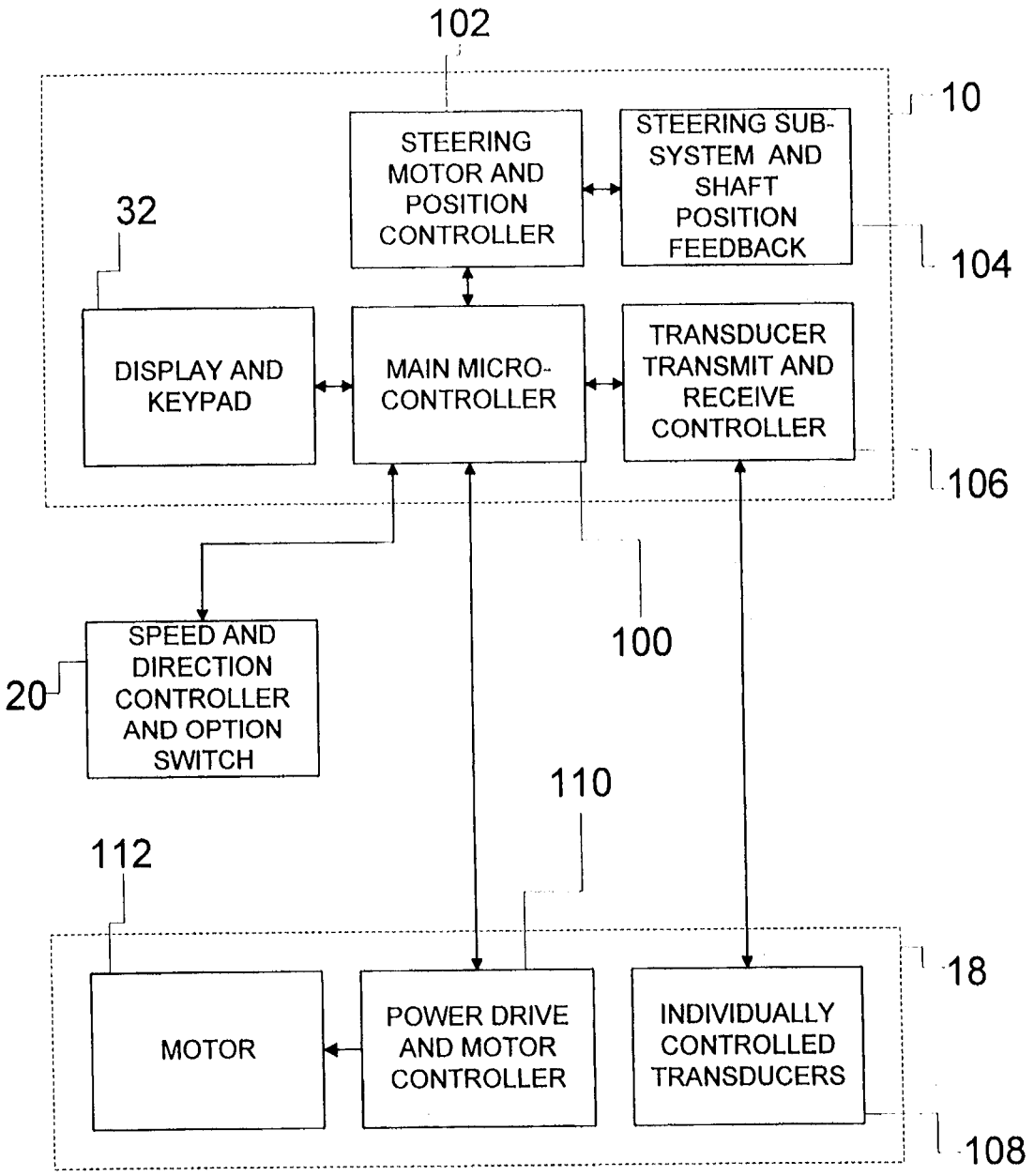

FIG. 7 is a functional block diagram showing the principal operative and detection and control components of an embodiment of the present invention.

FIGS. 8*a*, 8*b*, 8*c*, 8*d*, 8*e*, and 8*f* are flow chart diagrams illustrating the shore-tracking mode of the present invention.

FIGS. 9*a*, 9*b*, 9*c*, 9*d*, 9*e*, and 9*f* are flow chart diagrams illustrating the creek-tracking mode of the present invention.

FIGS. 10*a*, 10*b*, 10*c*, 10*d*, and 10*e* are flow chart diagrams illustrating the depth-tracking mode of the present invention.

DETAILED DESCRIPTION OF THE PREFERRED EMBODIMENT

Figure 1:
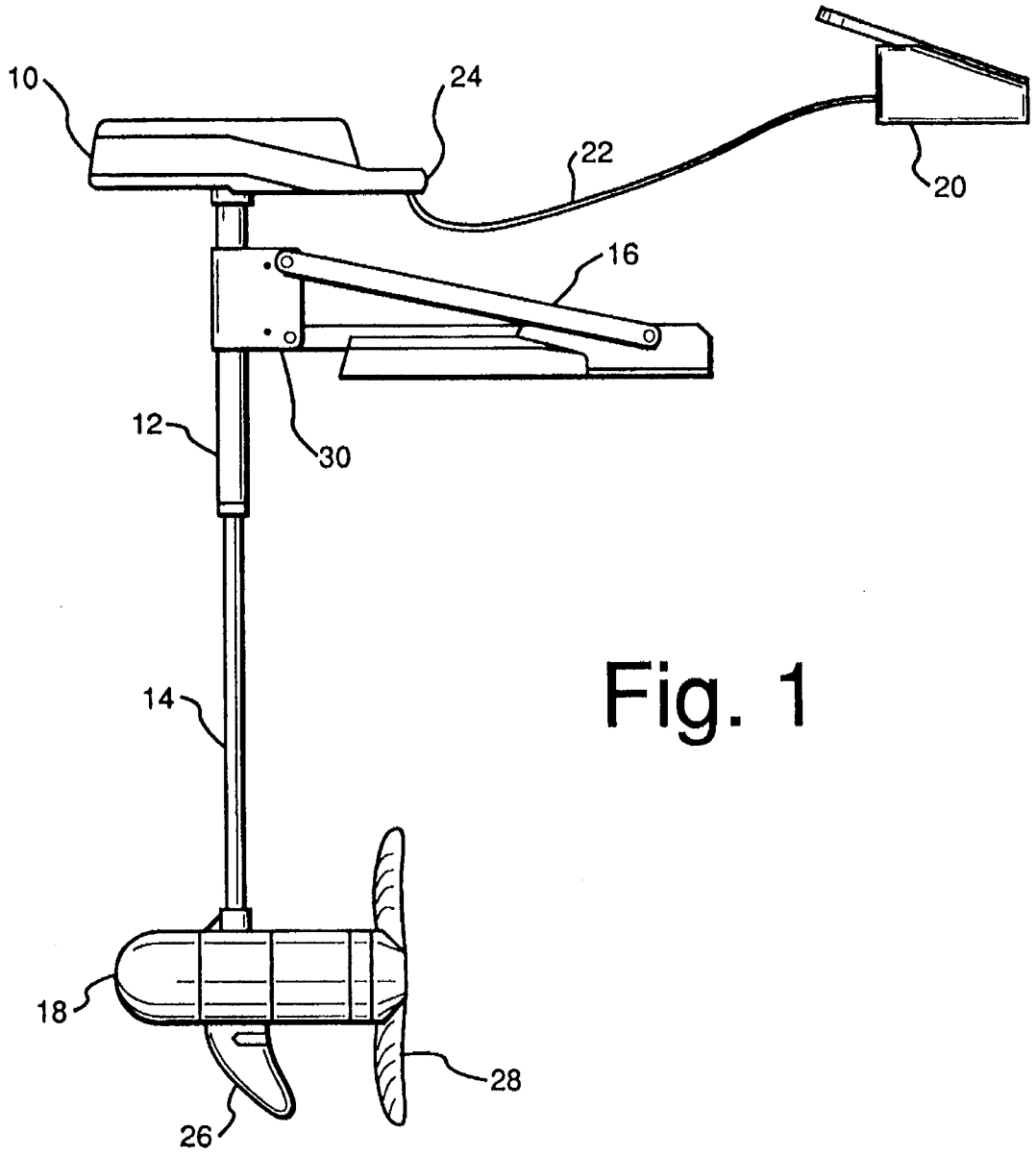
FIG. 1 is a side view of an embodiment of the present invention in the form a trolling motor, shaft, head unit, and foot pedal controller.

Referring to FIG. 1, there is a head unit 10 with a handle 24 and the head unit is mounted on a shaft sleeve 12. The shaft 14 is rotatable within the shaft sleeve and is controlled and actuated by a mechanism within the head unit. A trolling motor unit 18 having a fin 26 and a propeller 28 is attached to the other end of the shaft. There is a user-controlled foot pedal unit 20 communicatively attached via an electrical cord 22 to the head unit. Through this foot pedal unit, the user can, in addition to other features, manually steer the trolling motor unit and control its speed. There is a mounting bracket 16 attached to the shaft sleeve via an attachment bracket 30. The entire trolling motor unit can be attached to a boat via the mounting bracket. The mounting bracket allows the trolling motor unit to be lifted out of the water or to be submerged in the water.

Figure 2:
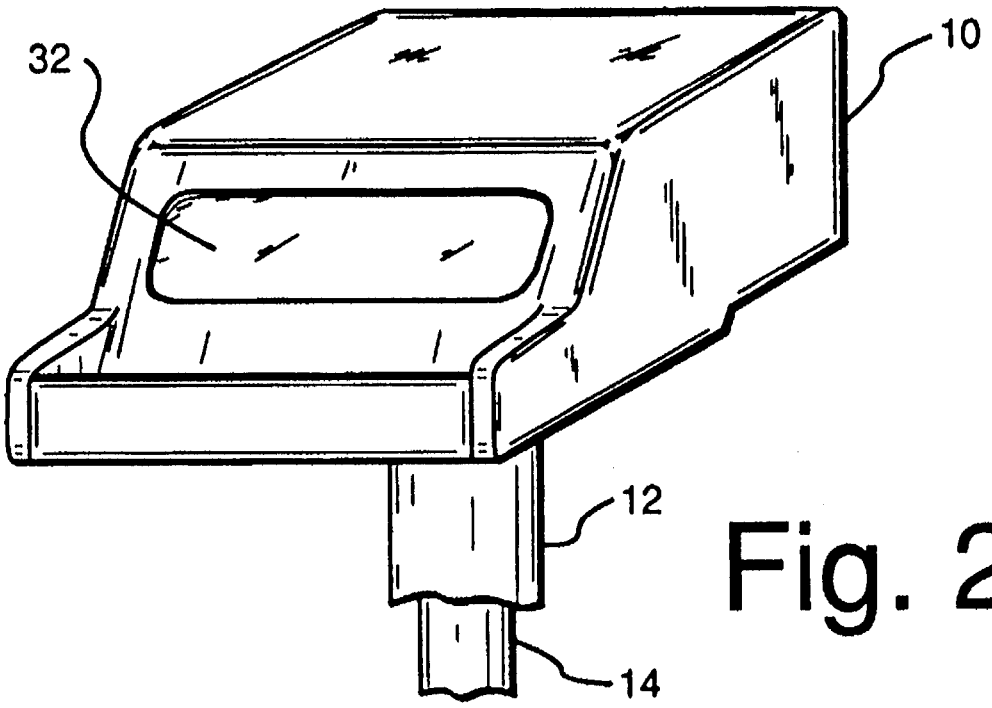
FIG. 2 is a perspective view of the head unit showing a display.
Figure 3:
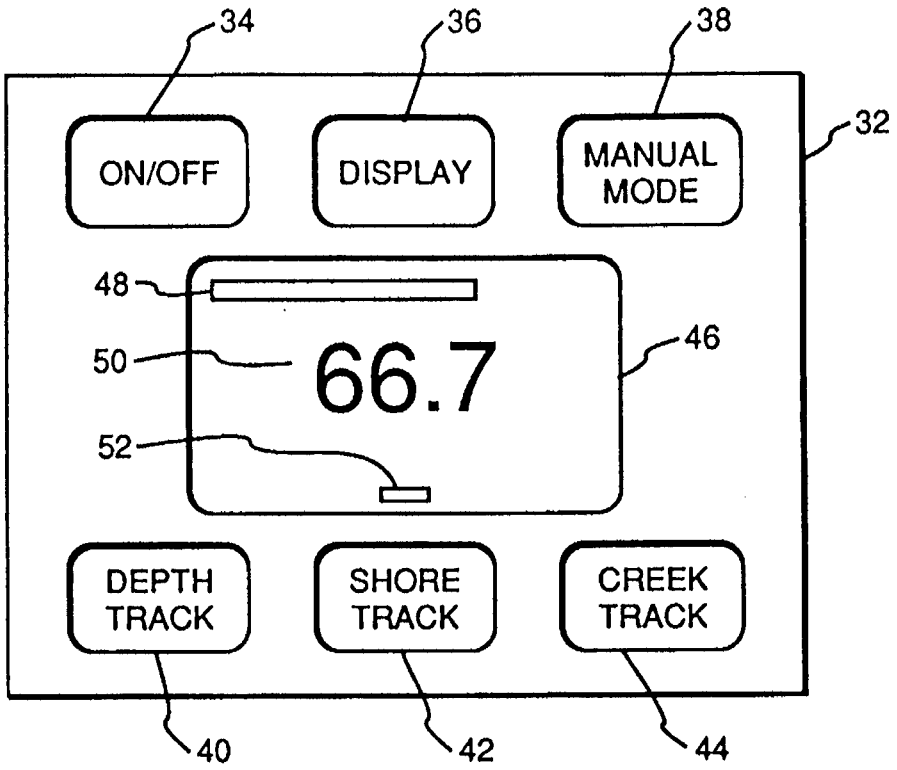
FIG. 3 is an enlarged view of the display having a keypad and a LCD screen.

In FIG. 2, the head unit 10, having a display and keypad 32, is mounted on the shaft sleeve 12 and attached to the shaft 14. Referring to FIG. 3, the preferred display and keypad 32 has six buttons on the keypad and one screen. There is an ON/OFF button 34 to power the unit, a DISPLAY button 36 allowing toggling between display of temperature and depth on the screen, a MANUAL MODE button 38 allowing the user to manually control the steering and speed of the trolling motor, a DEPTH TRACK button 40 to activate the Depth-Tracking Mode, a SHORE TRACK button 42 to activate the Shore-Tracking Mode, and a CREEK TRACK button 44 to activate the Creek-Tracking Mode. The screen 46 displays a bar 48 for battery strength, numbers 50 to show temperature (or depth), and a short bar 52 to indicate the selected mode.

Figure 4:
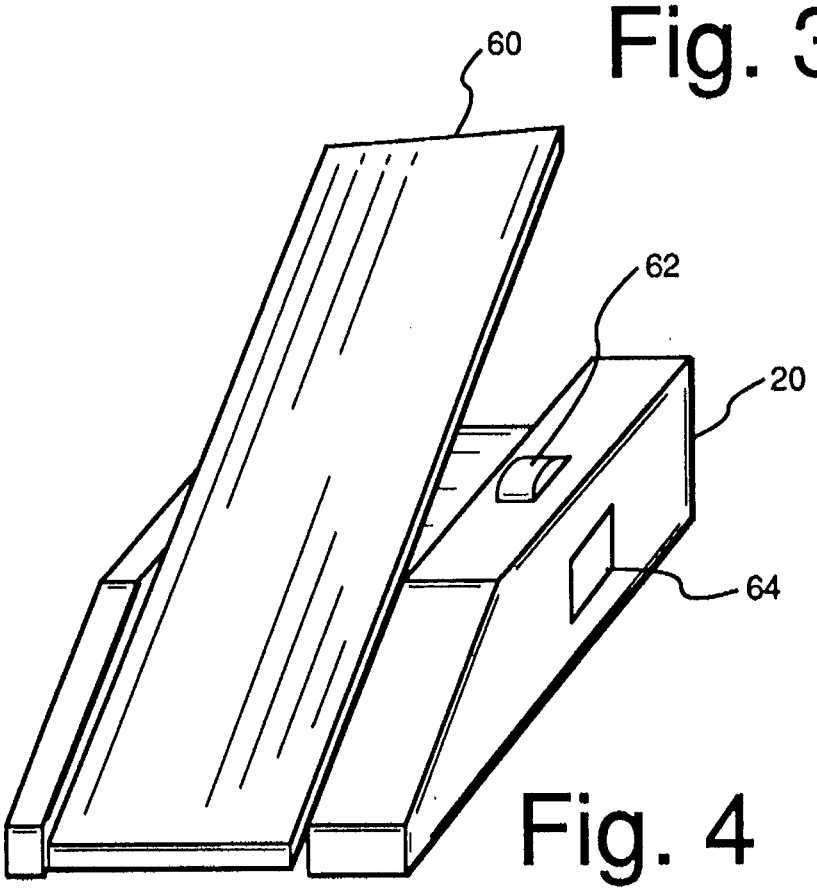
FIG. 4 is a perspective view of the foot pedal controller of the preferred embodiment.

Referring to FIG. 4, the foot pedal unit 20 has a foot pedal 60, a speed control dial 62, and an option button 64. By pressing the pedal away from the user, the trolling motor is steered toward port side; and by pressing the pedal toward the user, the trolling motor is steered toward starboard side. By maneuvering the foot pedal while in one of the three automatic modes, the transducer trolling system is returned to the manual mode. By pressing on the option button while in the manual mode, the system is returned to the previously activated automatic mode. By pressing on the option button while in the automatic mode, the system is instructed to command a U-turn.

The trolling motor unit 18, referring to FIG. 5*a*, has a nose cone 70 housing five transducers. The port 72 and port-down 74 transducers are illustrated. Behind the nose cone 70 is the front casting 76 containing the Power Drive and Motor controller. The motor shell 78 houses the motor and the propeller 80 is after the rear casting 82. In FIG. 5*b*, the arrangement of the transducers on the nose cone is illustrated. There is the port transducer 72, starboard transducer 90, port-down transducer 74, starboard-down transducer 88, and the down transducer 86.

Referring to FIG. 6*a*, in the preferred arrangement of the transducers in the nose cone, the port-down 74 and starboard-down transducers are angled at 15 degrees from a horizontal axis 92 running along the cone 70. Referring to FIG. 6*b*, a front view of the nose cone 70 shows that the down transducer 86 is positioned straight down, the port 72 and starboard 90 transducers are positioned 85 degrees from the down transducer 86, and the port-down 74 and starboard-down 88 transducers are positioned 21 degrees from the down transducer 86.

Referring to FIG. 7, a functional block diagram illustrates the relationship between the processing blocks. In the head unit 10, the main microcontroller 100 receives user commands regarding mode selection and display options via the keypad 32 and displays the selection and other information on the display screen 32. Once the mode is selected, the microcontroller activates the Transducer Transmit and Receive Controller 106 to send and receive signals to and from the selected transducers 108. With the information obtained from the transducers, the microcontroller calculates the appropriate steering and speed values. The steering value is sent to the Steering Motor and Position controller 102, and this controller instructs the Steering Subsystem 104 to actuate the steering motor (not shown) to turn the shaft in the proper direction and in the right amount. The Shaft Position Feedback System 104, using infrared transmitters and receivers (not shown) to read off decals on the shaft and gears (not shown), determines the actual amount of the turn by the shaft. The speed value is transmitted to the Power Drive and Motor controller 110 to effectuate the proper amount of power to the motor 112 for the given speed value. In any of the modes, the user can control the speed and direction of the trolling motor via the foot pedal unit 20.

The present invention offers three automatic modes in which the steering and speed of the trolling motor is entirely managed by an embodiment of the present invention. The three automatic modes are the shore-tracking mode, creek-tracking mode, and depth-tracking mode. In each mode, the transducers are activated and the returned values are processed through a series of program logic and look-up tables to output steering and speed values for the trolling motor.

The look-up tables are particularly important. They are developed based upon observed relationships between the different variables and empirically refined. There are several look-up tables for each mode. The look-up tables are not history tables and their values do not change.

In the shore-tracking mode, the microcontroller will steer the boat to travel at a fixed distance from the shore. In this mode, in addition to the boat-to-shore distance reading by the port or starboard transducer, the depth of the bottom terrain is also used to assist the program logic in determining the steering value. Here, the depth of the bottom terrain at a constant distance along the shore is assumed to be relatively unvarying or slow in varying as the boat travels along the shore.

The program flow for the shore-tracking mode is as follows:

Step 1: Initiation and Set-Up

Step 2: Error Processing Step

Step 3: Terrain Trend Adjustment Routine

Step 4: Steering Feedback Routine

Step 5: Steering Processing Step

Step 6: Large Turn Compensation Routine

Step 7: Drift Mode Routine

Step 8: U-Turn Routine

Step 9: Output Speed and Steering values to each of the controllers

Step 10: Go to Step 2 if Mode is not Cancelled

Figure 8A:
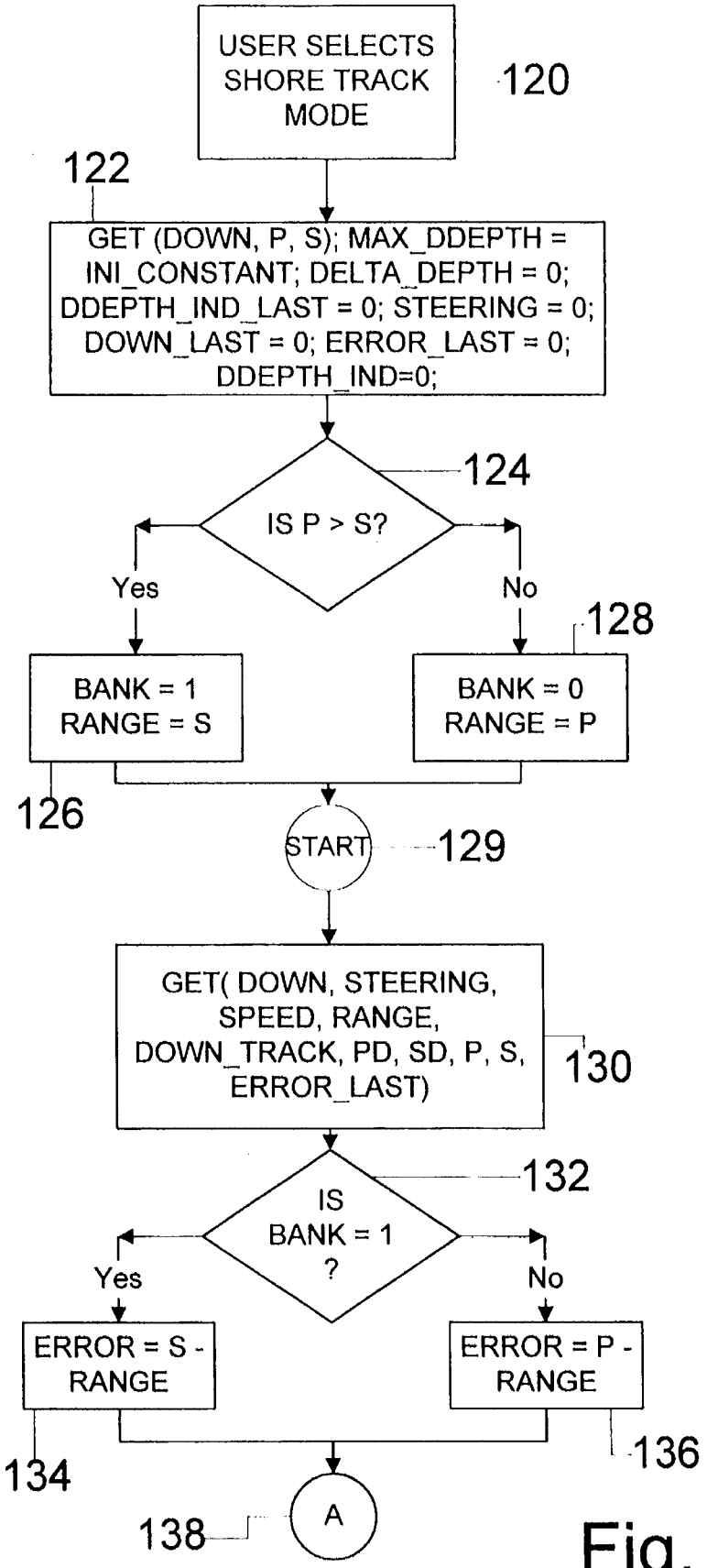

Referring to FIG. 8*a*, when the user selects the shore-tracking mode 120, a number of initiation steps are taken and a number of variables are initialized 122. The port side distance from shore ("P") and the starboard side distance from shore ("S") are obtained by activating the port and starboard transducers 122. If the port distance value is greater than the starboard distance value 124, the shore ("BANK") is on the port side and BANK is set to 1 to so indicate 126. Otherwise, shore is on the starboard side and BANK is set to 0 to so indicate 128. The user desired distance from shore ("RANGE") is set accordingly as well 126 or 128.

After initialization, a number of variables 130 necessary for calculating the error index and ultimately used in calculating the steering correction value ("STEERING") are obtained. First, the difference between the current distance from shore (P or S depending on BANK 132) and the desired distance from shore (RANGE) is determined ("ERROR") 134 or 136. The system will produce STEERING and SPEED values to reduce ERROR to a minimum. At this point, the program flows to connector "A" 138.

Figure 8B:
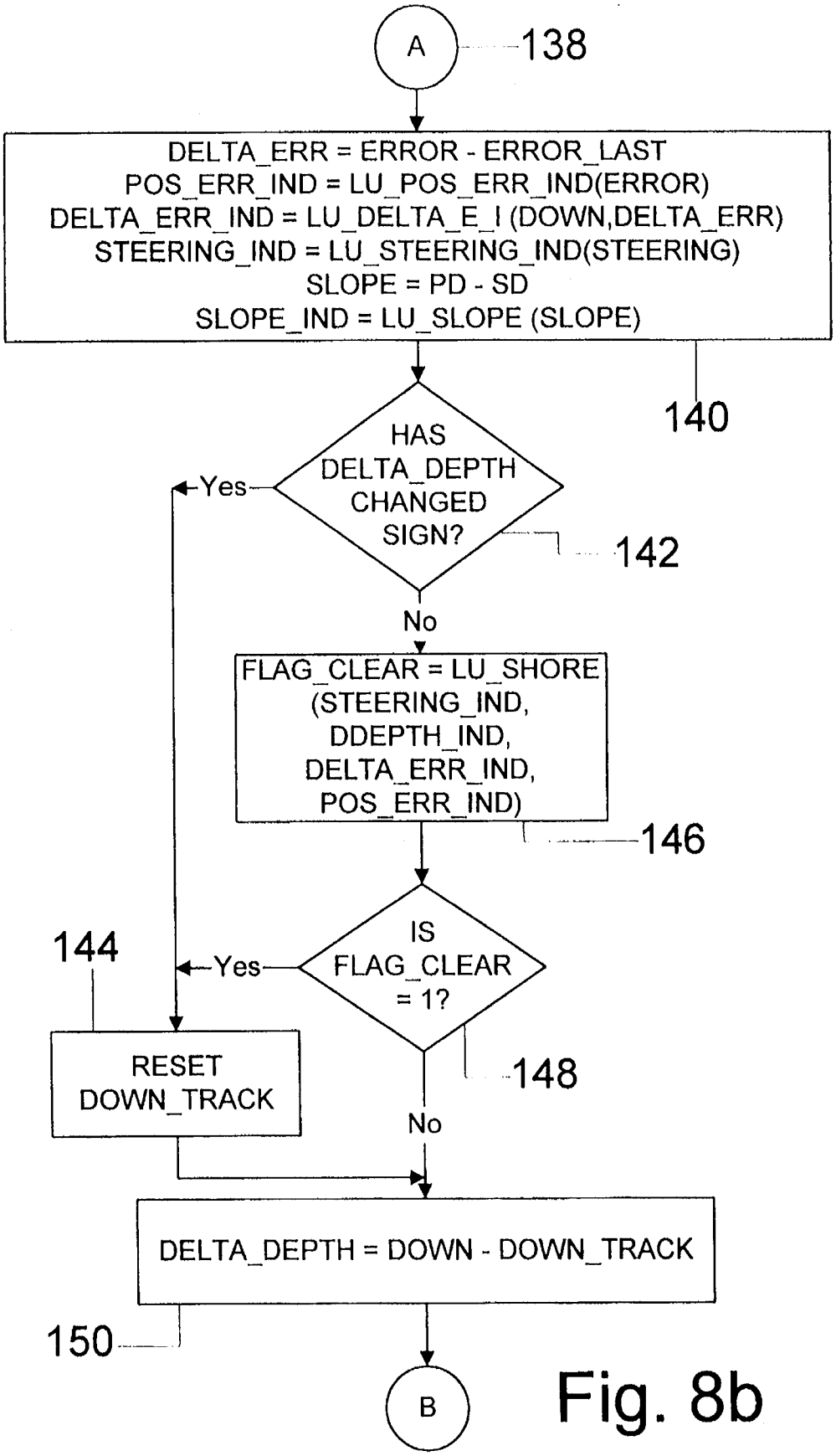

Referring to FIG. 8*b*, from connector "A" 138, the difference between ERROR and error from the last program cycle ("ERROR_LAST") defines the change in ERROR ("DELTA_ERR") . The Position Error Index ("POS_ERR_IND") is where the value for ERROR is quantified into an index by using the Position Error Index Look-Up table ("LU_POS_ERR") 140. Using a Delta Error Index Look-Up Table ("LU_DELTA_E_I"), the Delta Error Index ("DELTA_ERR_IND") is where the value for DELTA_ERR is quantified into an index value 140, and the DOWN value is used to reflect the fact that in deeper water the corresponding reading will be less accurate than in shallower water. Similarly, the Steering Index ("STEERING_IND") is where the Steering value ("STEERING") from the last program cycle is quantified into an index value by looking up the Steering Index table ("LU_STEERING_IND") 140. SLOPE is the difference between the distance values PD and SD read from the port-down transducer and the starboard-down transducer. SLOPE_IND is an index obtain from the Slope Index Look-Up Table ("LU_SLOPE").

The next processing step is the beginning of the Terrain Trend Adjustment Routine. In the shore-tracking mode, the assumption was made that the terrain remains non-varying or slow varying at a fixed distance along the shore. Thus, by tracking depth, the distance from the shore is being tracked to certain extent. In order to account for the change in the terrain, this routine allows resetting of depth relative to the shore ("DOWN_TRACK").

The initial depth relative to shore ("DOWN_TRACK") value is set to the downward depth ("DOWN") reading when the user activated this mode. As the boat travels along the shore, the depth reading ("DOWN") will either increase and continue to increase, decrease and continue to decrease, or reverse depth direction from increase to decrease or decrease to increase. The change in depth ("DELTA_DEPTH") is defined as the difference between current depth reading (DOWN) and ("DOWN_TRACK"). When DELTA_DEPTH changes sign 142, there is a reverse in direction and the depth to shore value (DOWN_TRACK) is reset to the current reading of DOWN 144. By reset DOWN_TRACK, the program is recognizing the change in terrain in relation to the shore.

If DELTA_DEPTH did not change sign, DOWN_TRACK can also be reset if conditions checked by the Shore Look-Up Table permits reset 146. DOWN_TRACK will be reset if the boat is being steered into deeper water as indicated by STEERING_IND, the boat is getting further from the shore as indicated by DELTA_ERR_IND and DDEPTH_IND, and the distance of the boat from shore as indicated by POS_ERR_IND is getting larger. If all four conditions are true, DOWN_TRACK will be reset to the current reading of DOWN 148 and 144. In this case, where the terrain is getting shallower (or deeper), the system is mistakenly steering the boat further away from the shore. To correct this situation, the Shore Look-Up Table ("LU_SHORE") is designed to allow this change in terrain by resetting DOWN_TRACK to allow the system to steer the boat back along the desired distance from the shore. In any case, DELTA_DEPTH is reevaluated, and this ends the Terrain Trend Adjustment Routine.

Figure 8C:
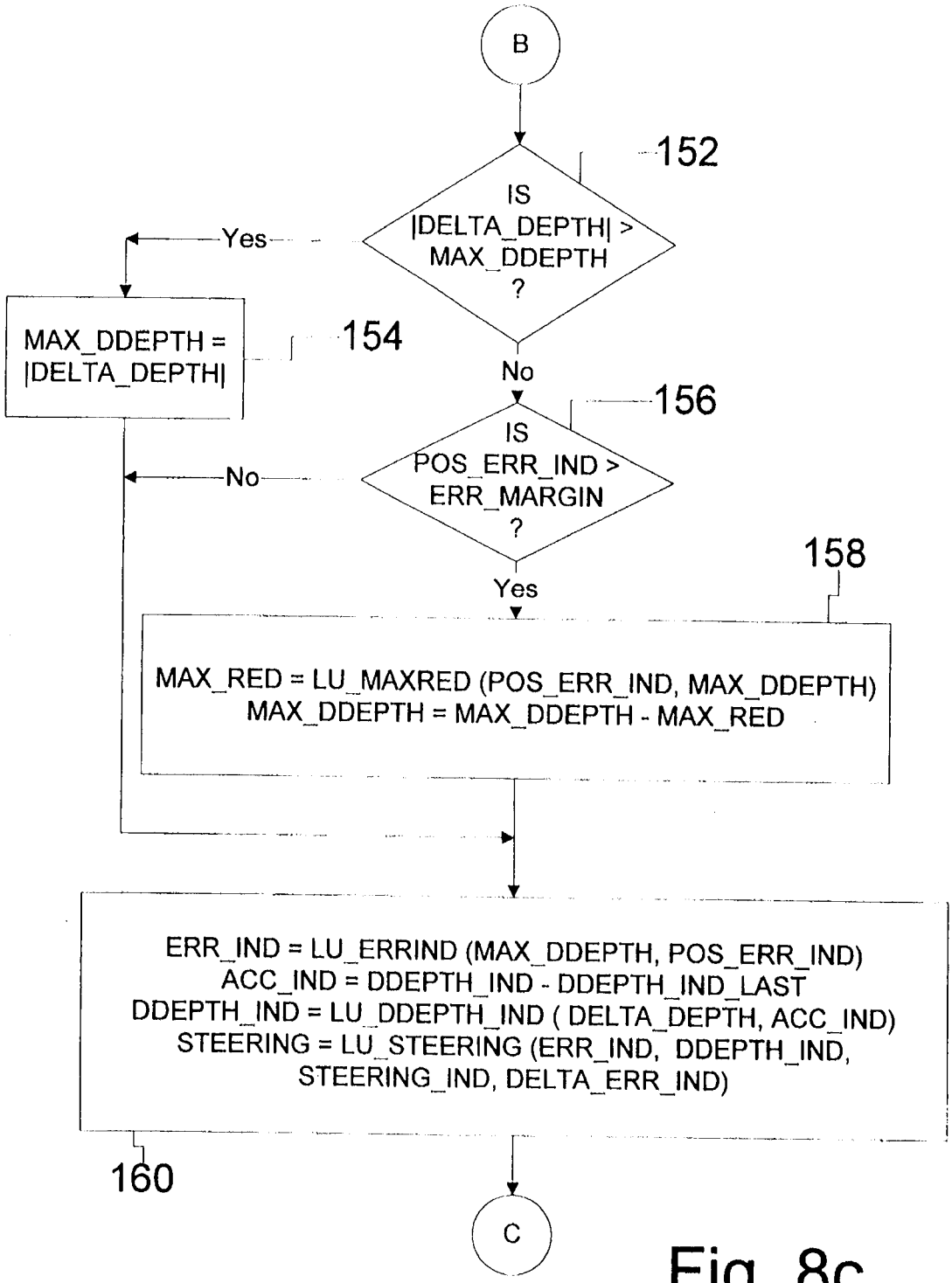

Going on to connector B of FIG. 8*c*, this is the beginning of the Steering Feedback Routine. The goal of this routine is to avoid oscillation created by over-steering. Oscillation may occur when the boat is over steered in one direction and the microcontroller determines that the boat needs to be steered in the other extreme, resulting in the boat traveling in a zig zag, rocking manner. The routine will damp over steering to allow the boat to travel in a smooth, gradual manner.

First, the maximum change in depth previously detected ("MAX_DDEPTH") is compared with the absolute value of the current change in depth (DELTA_DEPTH) 152. If the absolute value of DELTA_DEPTH is greater than MAX_DDEPTH, MAX_DDEPTH is set to DELTA_DEPTH 154 and thus recognizing maximum damping is necessary.

Otherwise, a reduction in damping is achieved by reducing MAX_DDEPTH by Maximum Delta Depth Reduction ("MAX_RED"). MAX_RED is determined from the MAX_RED Look-Up Table, quantifying the MAX_DDEPTH into an index value which is affected by POS_ERR_IND that is larger than a pre-set error margin. A larger Position Error Index (keeping MAX_DDEPTH constant), which indicates that a large steering adjustment is needed to return the boat back on course, will create a larger MAX_RED and thereby allowing a smaller MAX_DDEPTH 158 and subsequently a larger Error Index ("ERR_IND"). A larger Error Index will result in a larger Steering value. On the other hand, keeping POS_ERR_IND constant, a larger MAX_DDEPTH will result in a larger MAX_RED. After MAX_RED is determined, MAX_DDEPTH is correspondingly reduced by that amount 158, and this is the end of the Steering Feedback Routine.

The next processing step calculates for steering correction ("STEERING") 160. First, the Error Index ("ERR_IND") is determined from the Error Index Look-Up Table ("LU_ERRIND") by quantifying POS_ERR_IND into another index that is affected by MAX_DDEPTH. A larger MAX_DDEPTH will result in a smaller ERR_IND. The Acceleration Index ("ACC_IND") is calculated from the difference between the current Change in Depth Index (DDEPTH_IND) and the previous Change In Depth Index ("DDEPTH_IND_LAST"). Change In Depth Index (DDEPTH_IND) is obtained from the Change In Depth Look Up Table ("LU_DDEPTH_IND") by quantifying DELTA_DEPTH that is influenced by ACC_IND. A larger ACC_IND will result in a larger DDEPTH_IND, which tends to result in a larger steering correction.

Finally, Steering direction and magnitude ("STEERING") is determined from a Steering Look-Up Table ("LU_STEERING") with five inputs. By keeping other variables constant and varying one input at a time, the relationships between the variables are explained. There is an inverse relationship between ERR_IND and STEERING where a larger ERR_IND will call for a larger steering correction to correct the distance of the boat to the shore. There is a direct relationship between DDEPTH_IND and STEERING where a larger DDEPTH_IND will call for a smaller steering correction to account for the rapid movement of the boat over the bottom contours line. STEERING_IND has an inverse relationship with STEERING where a larger STEERING_IND will call for a smaller steering correction in order to reduce the possibility of oscillation. DELTA_ERR_IND has a direct relationship with STEERING where a larger DELTA_ERR_IND value will show the need for a more severe steering correction to steer the boat along the shore. Lastly, there is an inverse relationship between SLOPE_IND and STEERING where a large SLOPE would tend to indicate the need for a smaller steering correction to get the boat over to the correct contour. The STEERING value can be either a positive value demonstrating a port side steering correction or a negative value demonstrating a starboard side steering correction. Other numbering methods may be used as well.

Figure 8D:
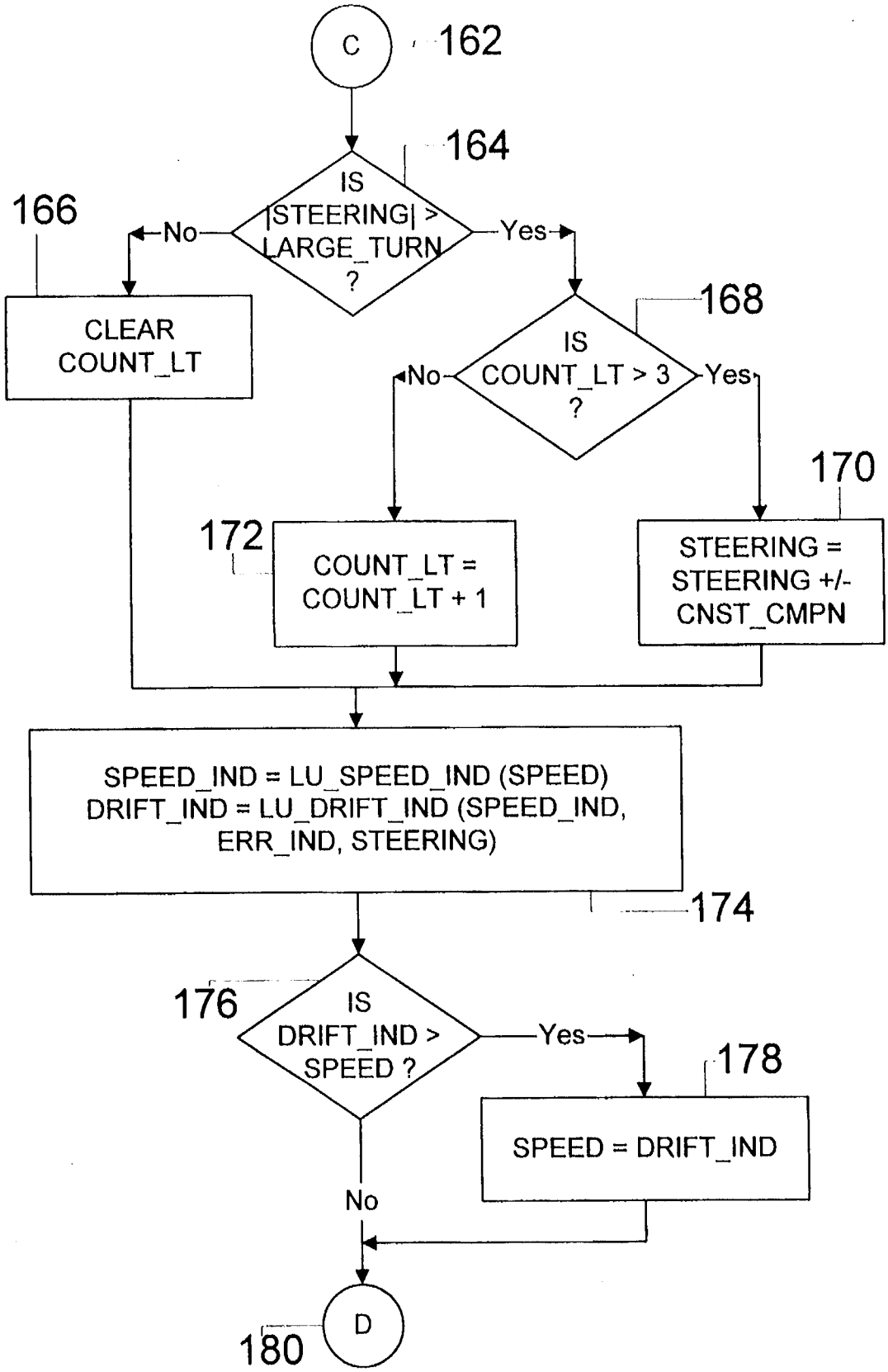

Moving to connector C on FIG. 8*d* 162, this is the beginning of the Large Turn Compensation Routine, which is a routine to allow a more severe steering correction every three program cycle in order to provide a faster turn. If the absolute value of STEERING is larger than sixty degrees 164, this is considered as a large turn and COUNT_LT is clear to initiate the count for compensation 166. For every three program cycles 168, STEERING is increased by a constant value ("CNST_CMPN") if STEERING is positive and decreased by CNST_CMPN if STEERING is negative 170. CNST_CMPN is about eight degrees in the preferred embodiment.

Next, the DRIFT ROUTINE calculates compensation of the given speed in order to account for drift current or wind. In any of the automatic modes, the user may set the desired speed of travel via the speed dial on the foot pedal unit. If there is a strong drift current, this speeding setting will need to be compensated in order to made headway in the water. First, the selected speed ("SPEED") is quantified into an index ("SPEED_IND") via the Speed Index Look Up Table. Then, the Drift Index ("DRIFT_IND") is obtained from the Drift Index Look-Up Table ("LU_DRIFT_IND") which has three input variables 174. The relationship between the variables and DRIFT_IND is illustrated through the following examples. In a case where the user sets a low speed, the system commands a large steering correction, and the ERR_IND is greater than some error margin, the DRIFT_IND will be higher and will be ever higher as ERR_IND increases. In another case where the user sets a high speed, the system commands a large steering correction, and the ERR_IND value is low, moderate, or even none existent, the DRIFT_IND will be low also. Finally, if the steering correction is low or nonexistent, DRIFT_IND will always tend to be lower than SPEED, which indicates that the boat is on or approaching its course. If DRIFT_IND is larger than SPEED 176, SPEED is set to DRIFT_IND 178.

Figure 8E:
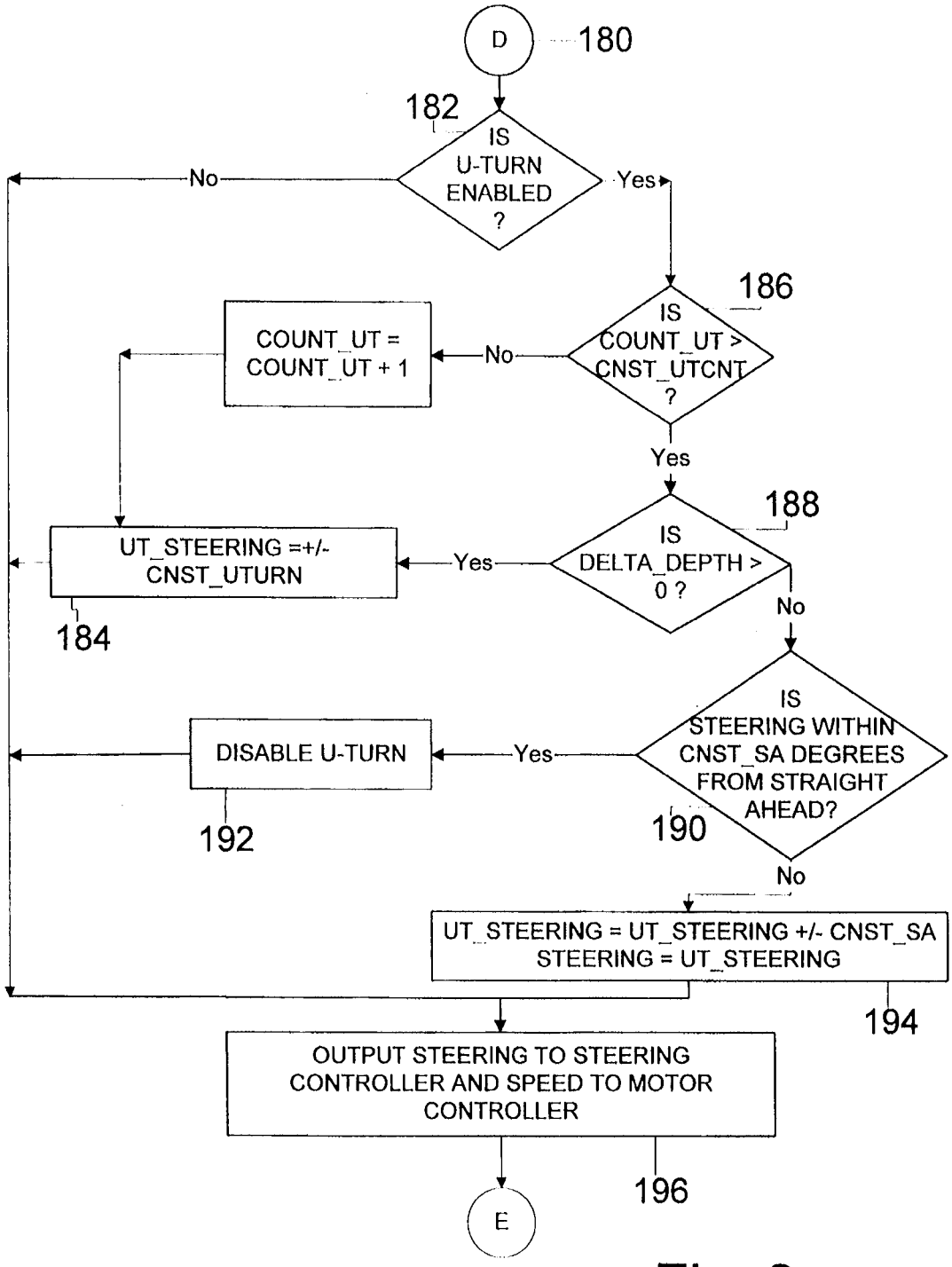

Referring to connector D 180 of FIG. 8*e*, this is the start of the U-Turn Routine. If the user enables automatic U-turn 182, STEERING is set to a constant value 184, here about 80 degrees. Note that the U-turn will always be executed away from the shore so STEERING is set to a positive or negative value depending on the shore. STEERING is set to (+ or −) CNST_UTURN for a predetermined number ("CNST_UTCNT") of program cycles in order to come close to completing the U-turn. Here, CNST_UTCNT is initialized to sixteen with the expectation that the U-turn will be close to completion in sixteen program cycles 186. When the U-turn constant count (CNST_UTCNT) is reached, if the boat is still heading into deeper water (DELTA_DEPTH>0) 188 which indicates that the turn is not yet close to completion because is not yet going toward the shore, the program will continue to allow STEERING be set to CNST_UTURN to complete the U-turn. If the boat is steering toward shallower water 188 which indicates that the boat is coming to completion of the U-turn, and if the U-Turn Steering ("UT_STEERING") is within the Straight Ahead Constant value ("CNST_SA") 190, which is twelve degrees in the preferred embodiment, the U-turn is completed and the mode is disabled 192. Otherwise, if the boat is steering toward shallower water but UT_STEERING is greater than CNST_SA, UT_STEERING is reduced by CNST_SA 194, and steering is set to UT_STEERING. Over a few program cycles, the UT_STEERING value will be reduced to within CNST_SA value range and the U-turn mode will be disabled 192.

After the U-Turn Routine 196, the value of SPEED is transmitted to the Power Drive And Motor controller and the value of STEERING is transmitted to the Steering Motor and Position Controller to carry out the output values.

Figure 8F:
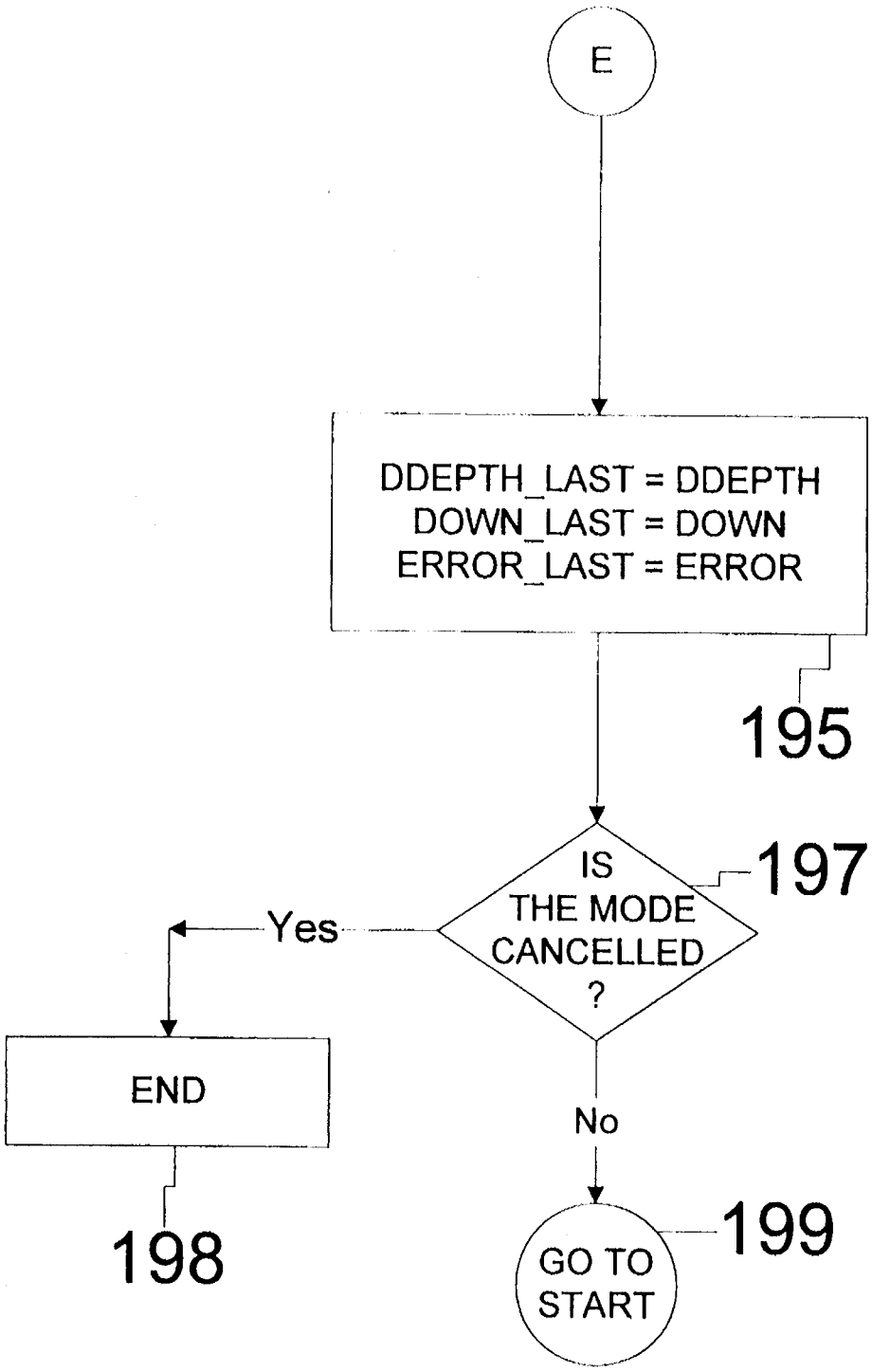

At this point, referring to FIG. 8*f*, certain variables are initialized 195 if the mode is not cancelled by the user, and program flow goes back to connector START 129 on FIG. 8*a*. Otherwise, the program ends 198.

The program logic for the creek-tracking mode is substantially the same as in the shore-tracking mode. In this mode, the microcontroller will find the deepest terrain for the given body of water. The program flow for the creek-tracking mode is as follows:

Step 1: Initiation and Set-Up

Step 2: Error Processing Step

Step 3: Terrain Trend Adjustment Routine

Step 4: Steering Feedback Routine

Step 5: Steering Processing Step

Step 6: Large Turn Compensation Routine

Step 7: Drift Mode Routine

Step 8: U-Turn Routine

Step 9: Output Values Speed and Steering to each respective controller

Step 10: Go to Step 2 if Mode is not Cancelled

Figure 9A:
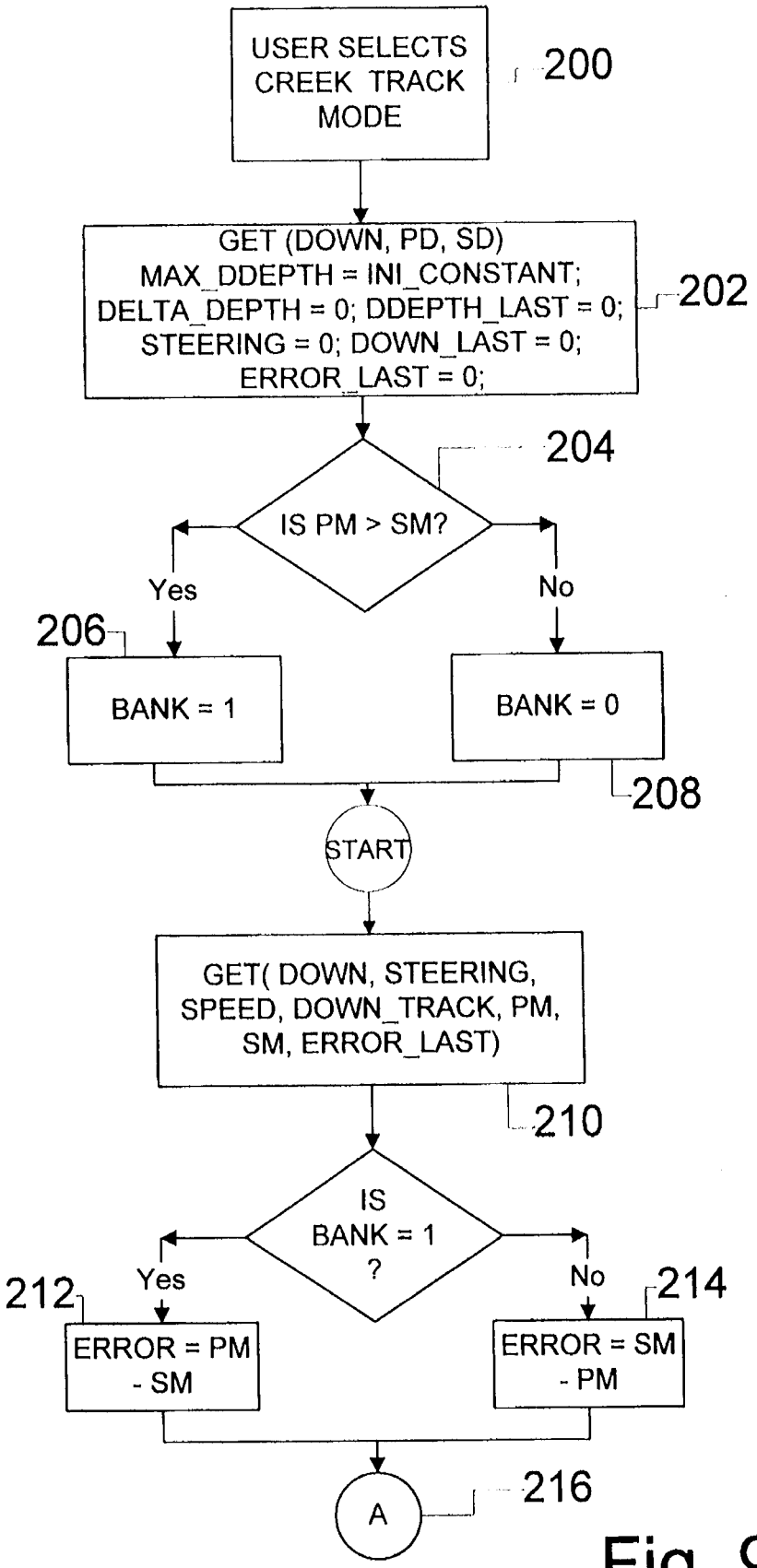

Referring to FIG. 9*a*, when the user selects the creek-tracking mode 200, a number of initiation steps are taken and a number of variables are initialized 202. The port-down ("PD") and starboard-down ("SD") transducers are activated to find the distance from the bottom terrain on both sides 204. These distance values are used to determine the location of the shore ("BANK") 206 or 208.

After Initialization, a number of variables necessary for calculating the error index 210 and ultimately used in calculating the steering correction value ("STEERING") are obtained. First of all, the difference between the PD value and SD value defines the error ("ERROR") 212 or 214. Because the program is searching for the deepest part of the terrain, ideally PD and SD should be about the same. The program now flows to connector A 216.

Figure 9B:
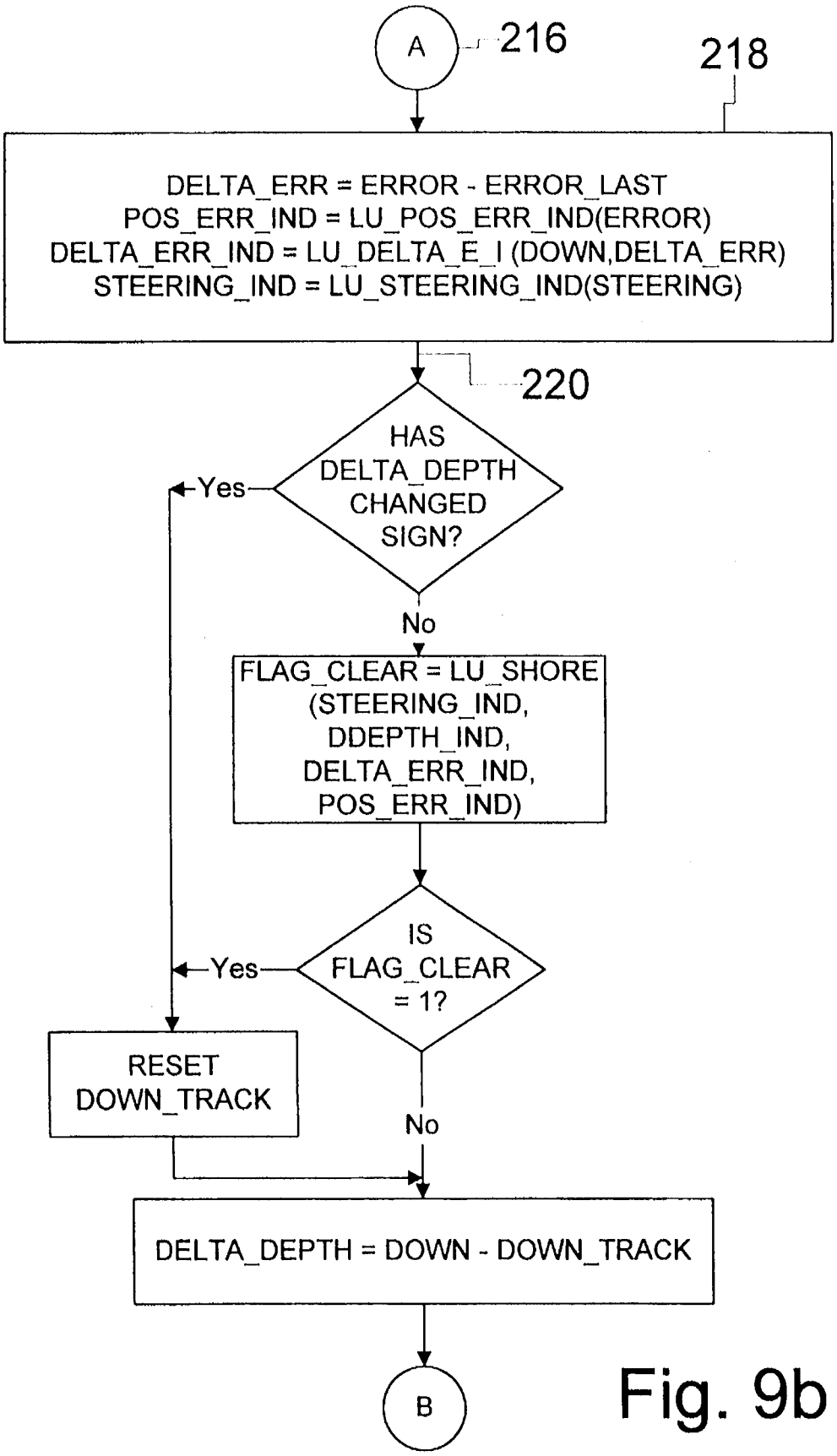
Figure 9C:
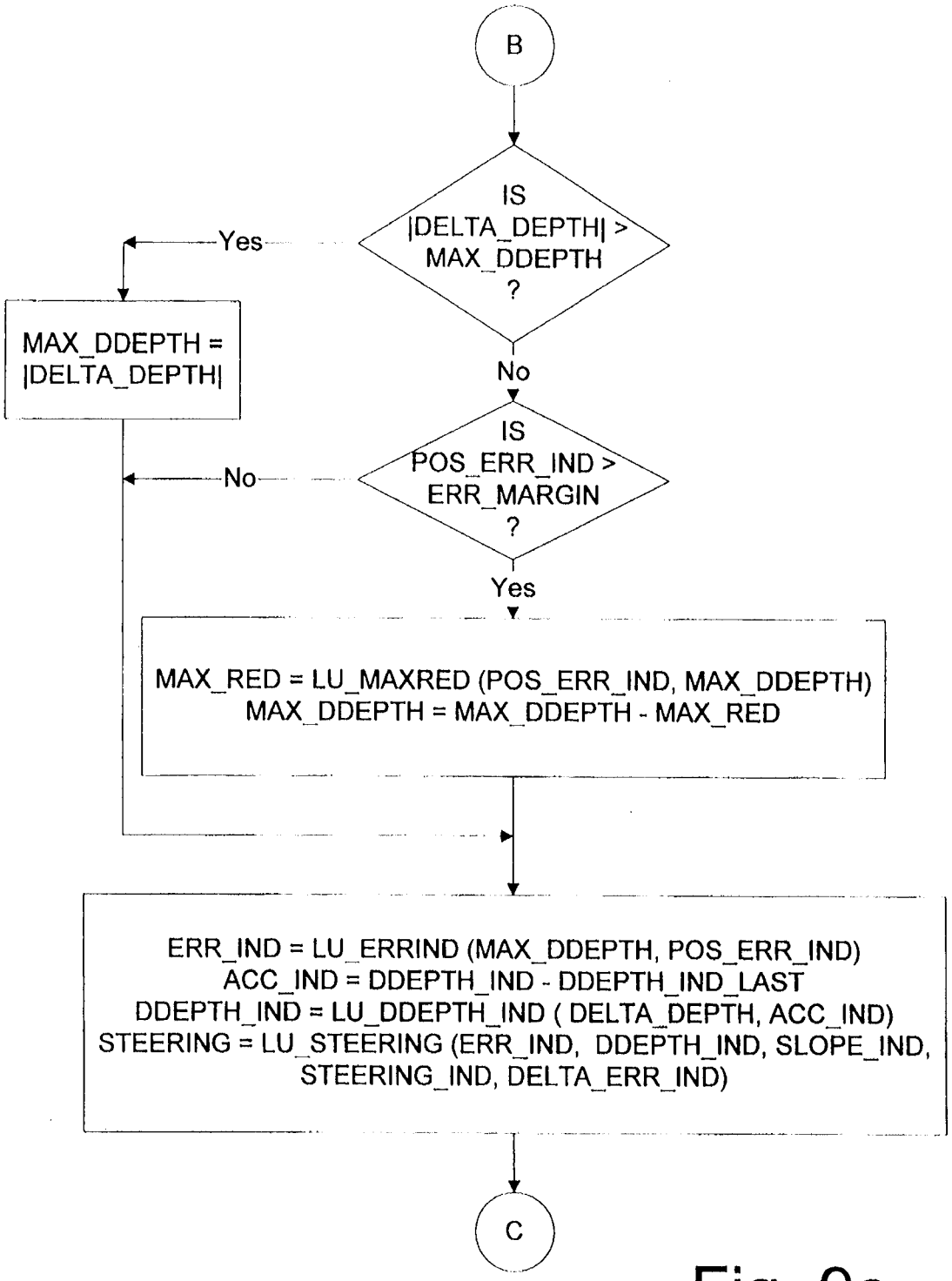
Figure 9D:
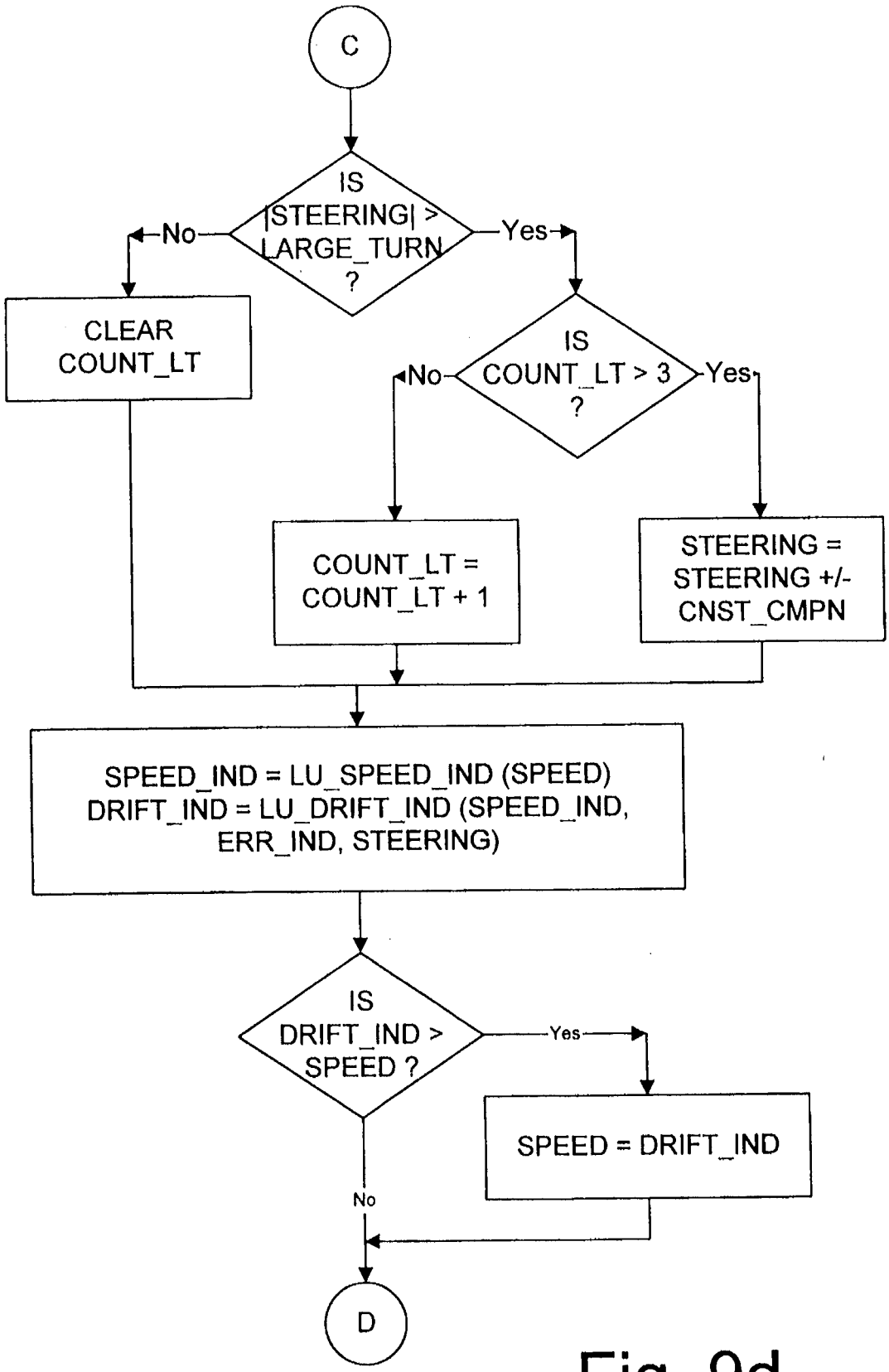
Figure 9E:
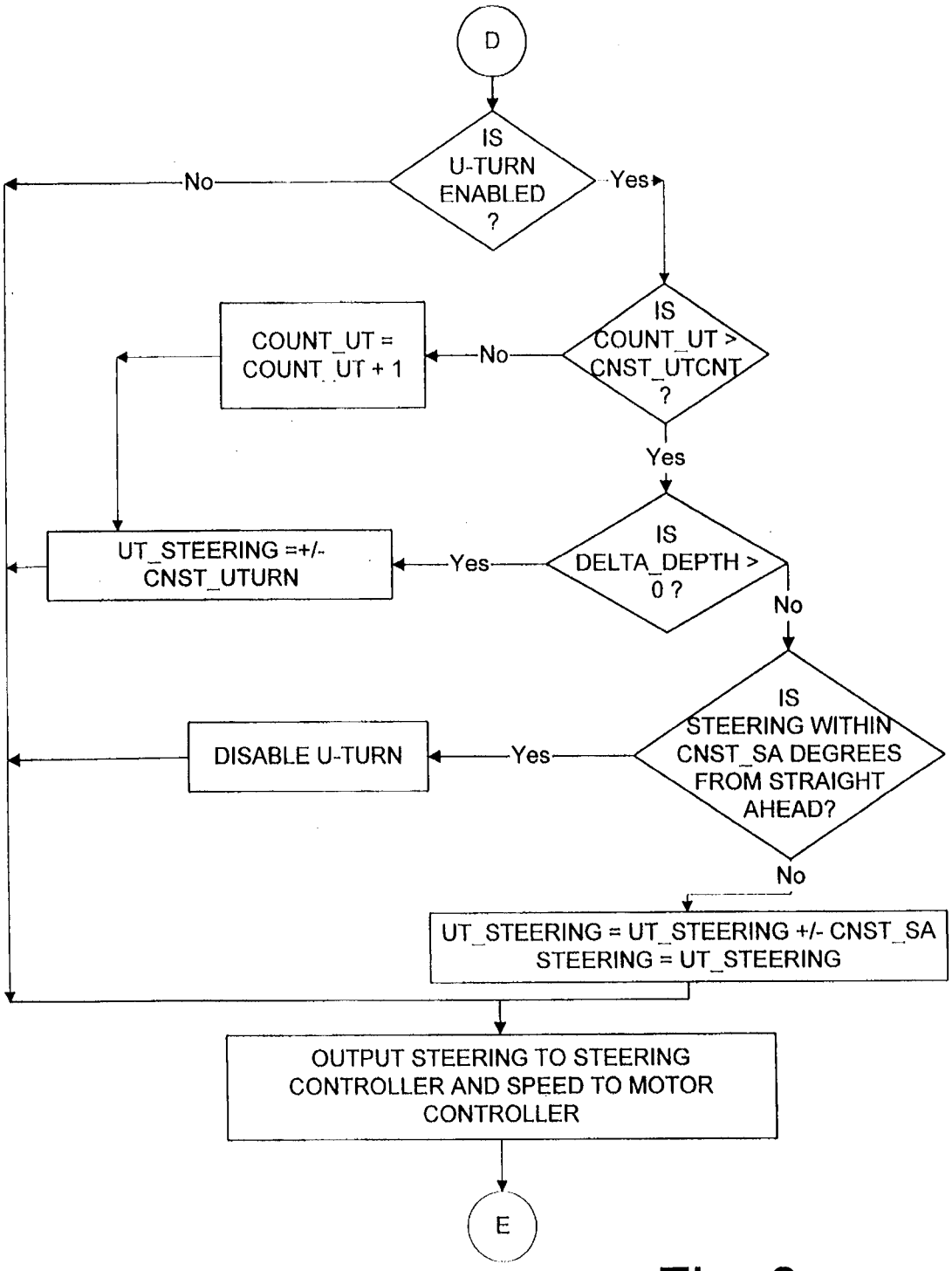
Figure 9F:
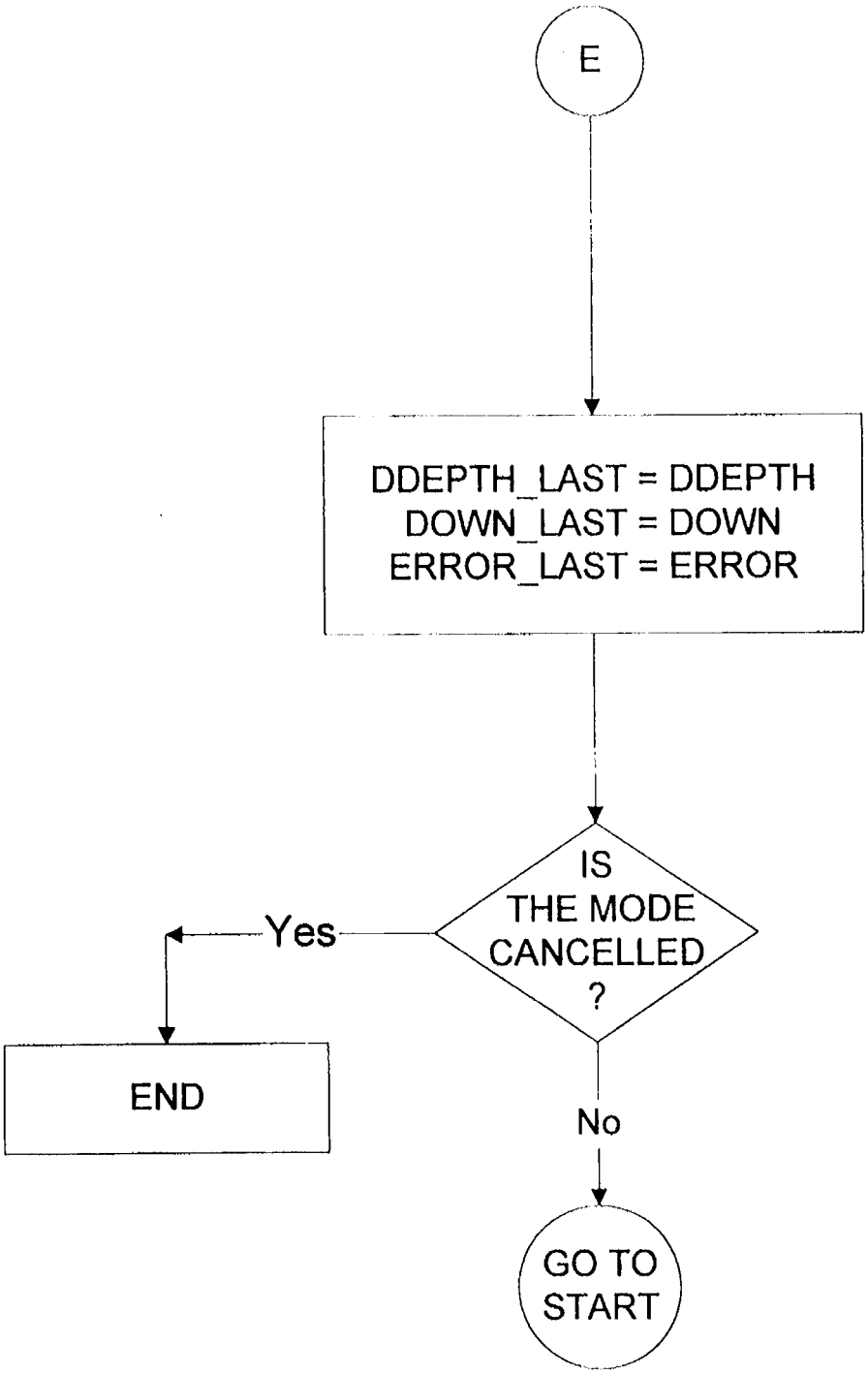

Referring to FIG. 9*b*, from connector A 216, the difference between ERROR and error from the last program cycle ("ERROR_LAST") defines the change in error ("DELTA_ERR") 218. The Position Error Index ("POS_ERR_IND") is where the value for ERROR is quantified into an index by using the Position Error Index Look-Up table ("LU_POS_ERR_IND") 218; the Delta Error Index ("DELTA_ERR_

IND") is where the value for DELTA_ERR is quantified into an index value 218; and similarly the Steering Index ("STEERING_IND") is where the Steering value ("STEERING") from the last program cycle is quantified into an index value by looking up the Steering Index table ("LU_STEERING_IND") 218.

From this point 220 on, with only two exceptions, program processing steps 6 through 10 as illustrated in FIGS. 9*b*, 9*c*, 9*d*, 9*e*, and 9*f* are the same as in the Shore-Tracking Mode. The first exception is that all the look-up tables in Creek-Tracking Mode are tailored to this mode and are therefore different from the look-up tables in the Shore-Tracking Mode. The second exception is that while Shore-Tracking Mode refers to SLOPE and SLOPE_IND values, Creek-Tracking Mode does not refer to them.

Likewise, the programming logic of Depth-Tracking Mode is similar to that in Shore-Tracking Mode. In this mode, the microcontroller will maintain the boat on a certain contour of the bottom terrain. The program flow for the Depth-Tracking Mode as follows:

Step 1: Initiation and Set-Up

Step 2: Error Processing Step

Step 3: Steering Feedback Routine

Step 4: Steering Processing Step

Step 5: Large Turn Compensation Routine

Step 6: Drift Mode Routine

Step 7: U-Turn Routine

Step 8: Output Values Speed and Steering (steering correction) to each respective controllers Step 9: Go to Step 2 if Mode is not Cancelled Referring to FIG. 10*a*, when the user selects the depth-tracking mode 230, a number of initiation steps are taken and a number of variables are initialized 232. The port-down ("PD") and starboard-down ("SD") transducers are activated to find the distance from the bottom terrain on both sides 234. These distance values are used to determine the location of the shore ("BANK") 236 or 238. Furthermore, the desired depth range ("RANGE") is set to the distance value obtained from the Down transducer (DOWN) 240.

After initialization, a number of variables necessary for calculating the error index 242 and used in calculating the steering correction value ("STEERING") are obtained. First of all, the difference between the desired range (RANGE) and current depth reading (DOWN) defines the error ("ERROR") 244. Because the program is searching for a certain depth, ideally RANGE and DOWN should be about the same. The Position Error Index ("POS_ERR_IND") is where the value for ERROR is quantified into an index by using the Position Error Index Look-Up table ("LU_POS_ERR") 244; similarly the Steering Index ("STEERING_IND") is where the Steering value ("STEERING") from the last program cycle is quantified into an index value by looking up the Steering Index table ("LU_STEERING_IND") 244; and the Change in Depth (DELTA_DEPTH) is defined as DOWN subtracting DOWN_LAST 244, DOWN_LAST being the DOWN distance value from the last program cycle. This now ends the Error Processing Step, and the program flows to connector A 246.

Figure 10A:
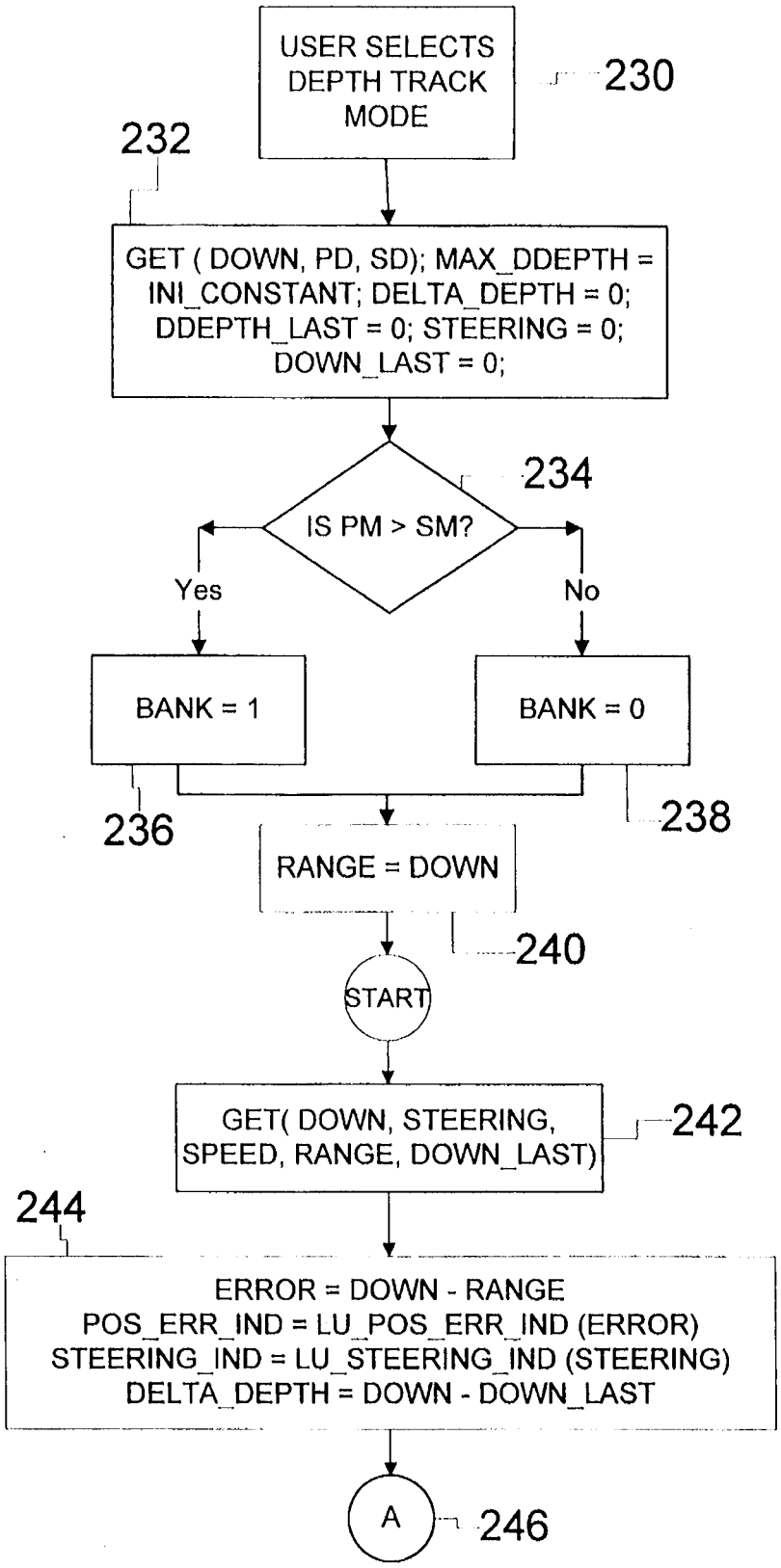
Figure 10B:
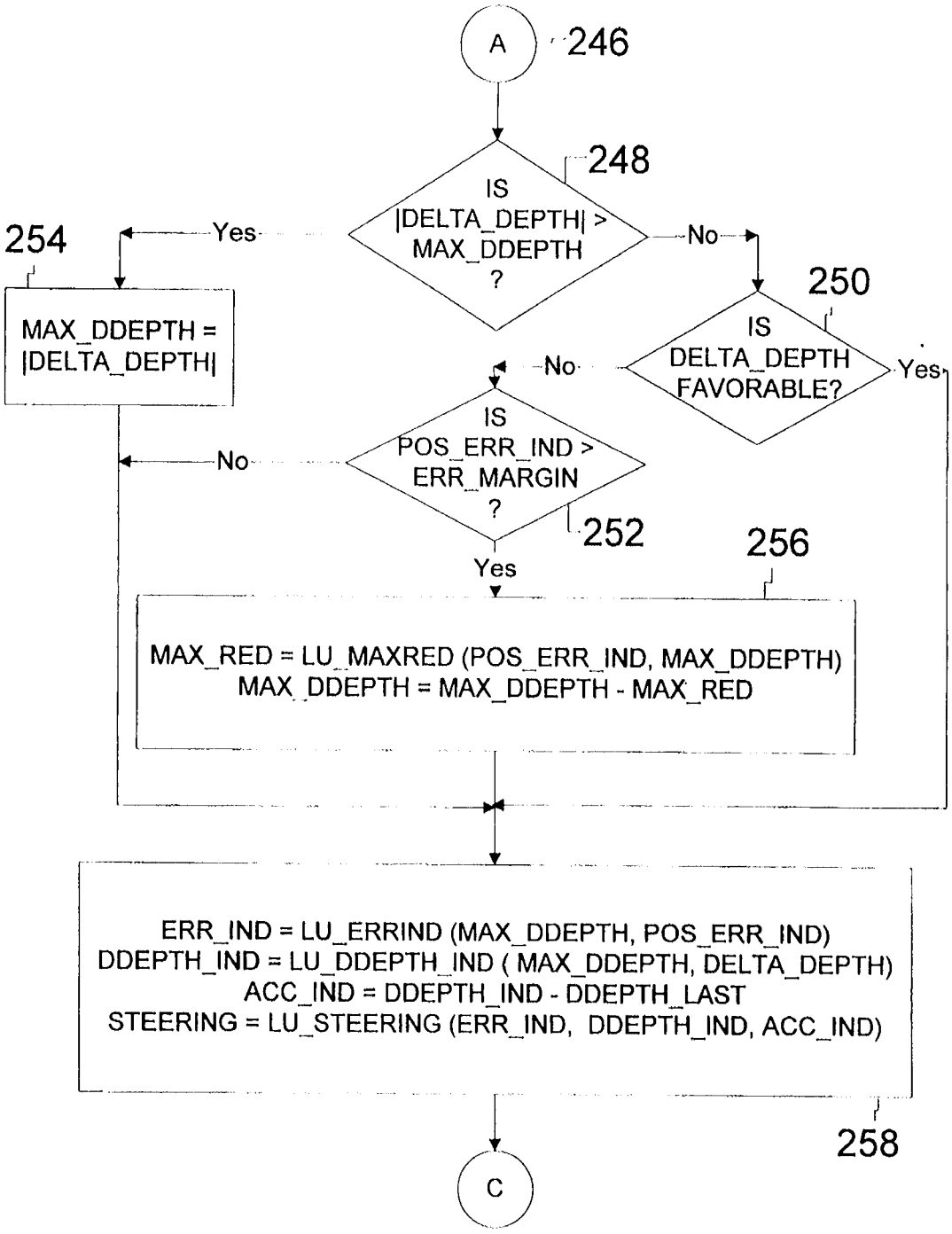

Referring to FIG. 10*b*, connector A 246, this is the beginning of the Steering Feedback Routine of the above modes. This routine is the same as the Steering Feedback Routine with the only difference being an additional decision box 250 that is added. If the absolute value of DELTA_DEPTH is greater than MAX_DDEPTH 248 and if DELTA_DEPTH is favorable, meaning the boat is heading toward the desired depth, reduction of MAX_DDEPTH is necessary and the program flows to the Steering Processing step 258.

In this step, the steering correction ("STEERING") is calculated. First, the Error Index ("ERR_IND") is determined from the Error Index Look-Up Table ("LU_ERR-IND") by quantifying POS_ERR_IND into another index that is affected by MAX_DDEPTH. A larger MAX_DDEPTH will result in a smaller ERR_IND. Change In Depth Index (DDEPTH_IND) is obtained from the Change In Depth Look Up Table ("LU_DDEPTH_IND") by quantifying DELTA_DEPTH that is influenced by MAX_DDEPTH. A larger MAX_DDEPTH will result in a smaller DDEPTH_IND. MAX_DDEPTH has an inverse relationship with DDEPTH_IND and it damps DDEPTH_IND by to normalizing DELTA_DEPTH in the sense that DELTA_DEPTH is taken as a percentage of MAX_DDEPTH. The Acceleration Index ("ACC_IND") is calculated from the difference between the current Change In Depth Index (DDEPTH_IND) and the previous Change In Depth Index ("DDEPTH_IND_LAST"). Finally, Steering direction and magnitude ("STEERING") is determined from a Steering Look-Up Table ("LU_STEERING") with three inputs. Of the three variables, two of them, ERR_IND and DDEPTH_IND, have the same relationship as previously described in the shore-tracking mode. As with ACC_IND, it has an inverse relationship with STEERING and it buffers large change in DDEPTH_IND in order to prevent oscillation.

Figure 10C:
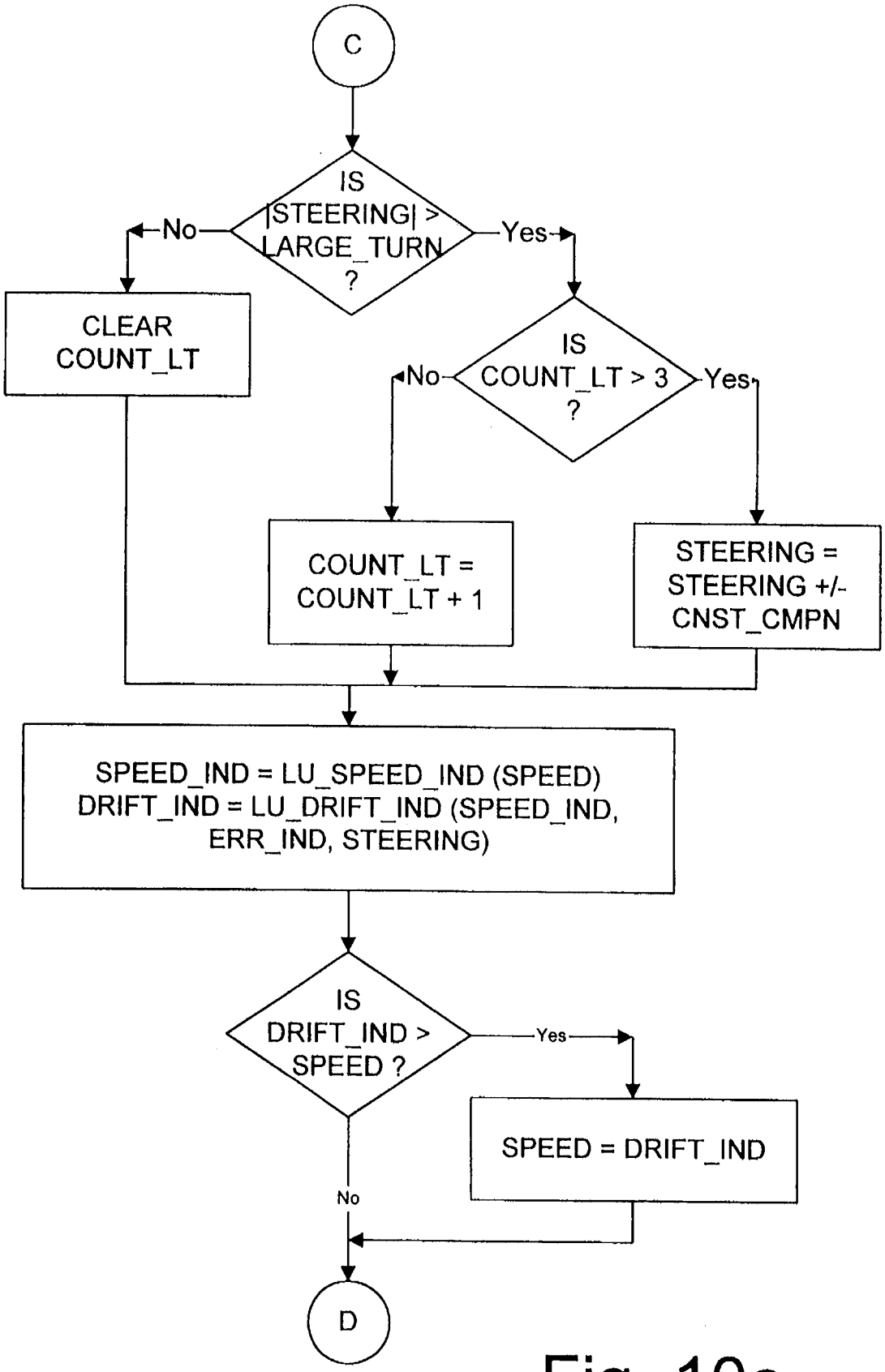
Figure 10D:
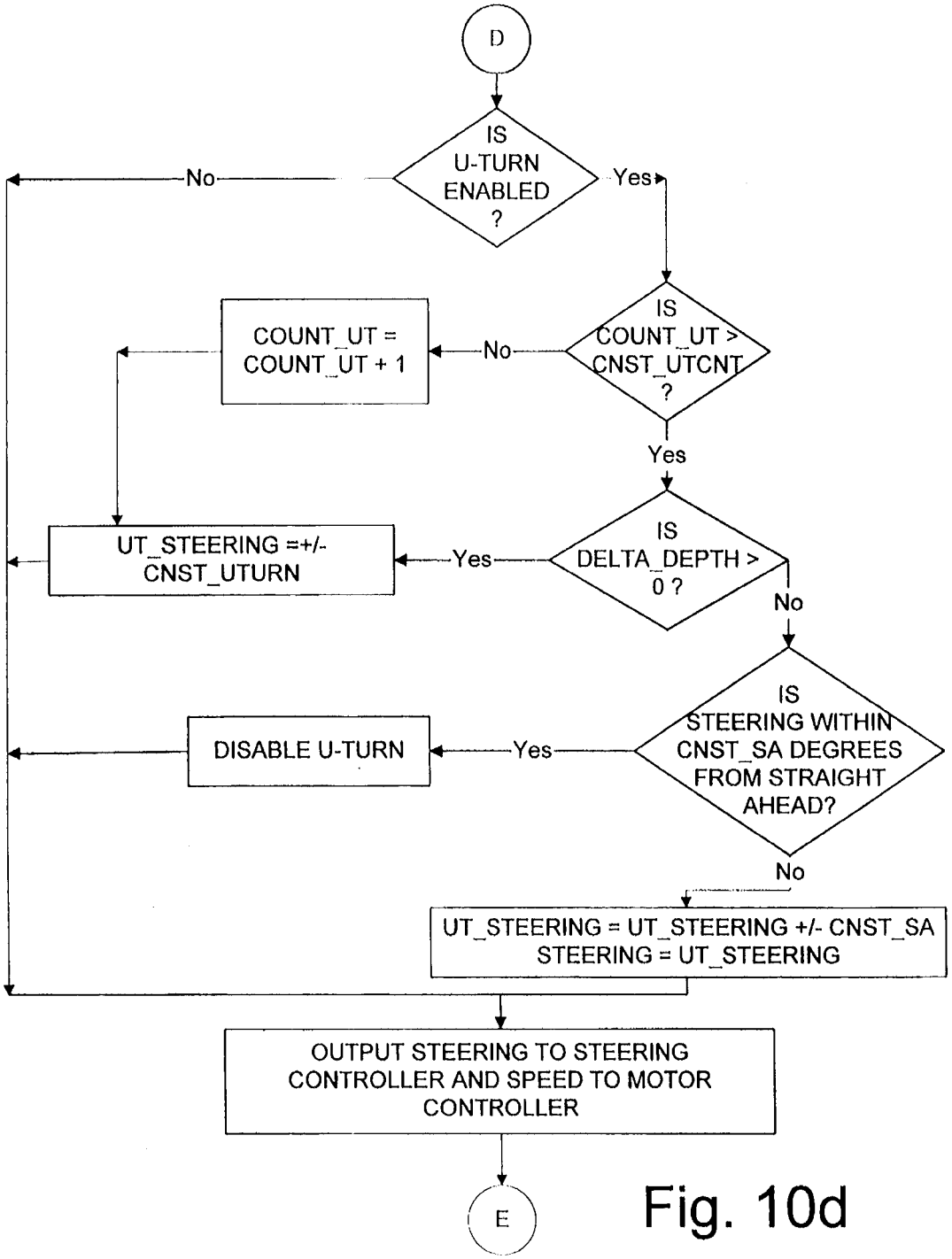
Figure 10E:
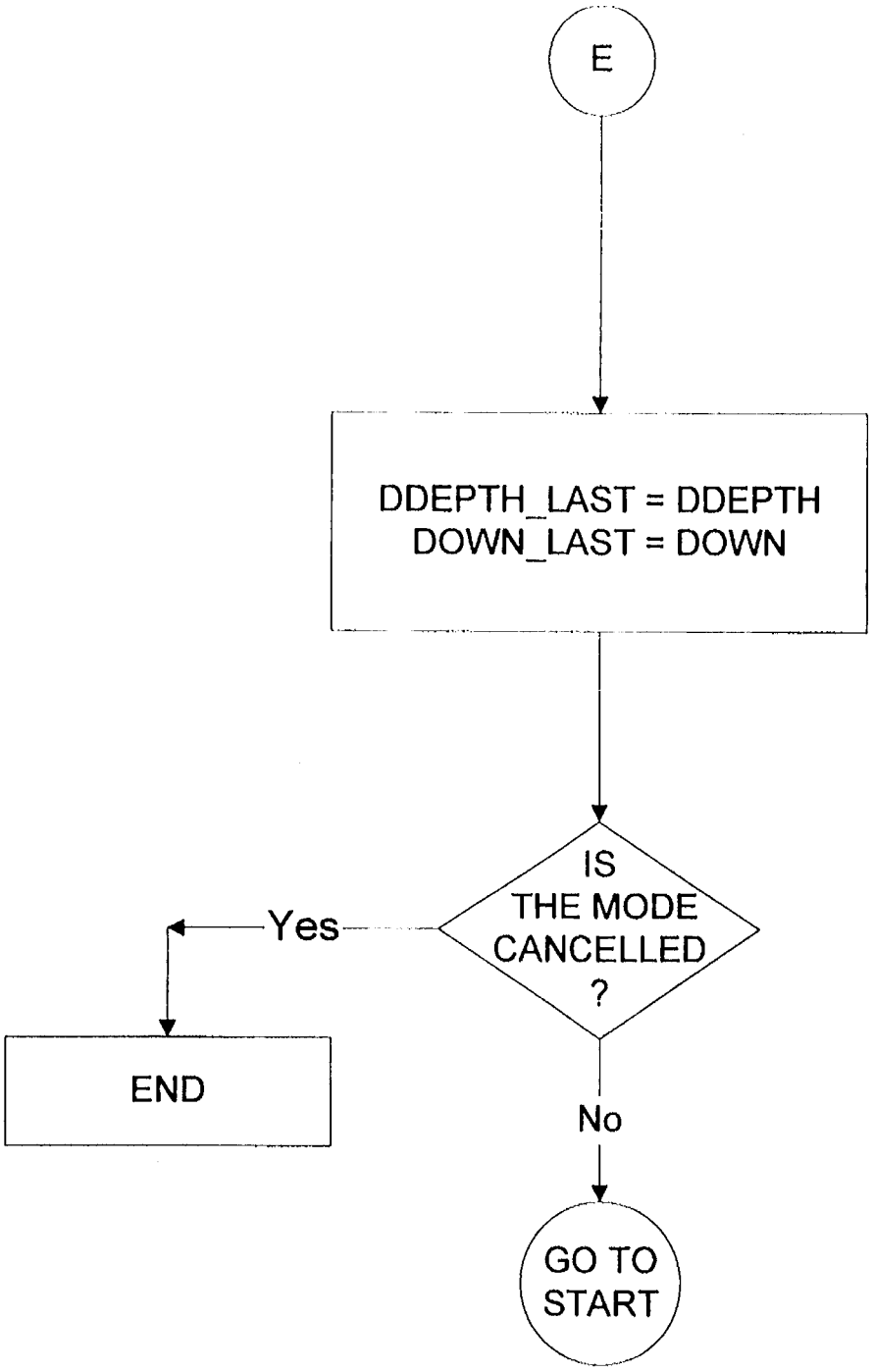

After calculating STEERING, the remaining steps 5 through 9 as illustrated in FIGS. 10*c*, 10*d*, and 10*e* are the same as previously described in the shore-tracking mode and the creek-tracking mode.

Although the present invention has been described above in terms of a specific embodiment, it is anticipated that alterations and modifications thereof will no doubt become apparent to those skilled in the art. It is therefore intended that the following claims be interpreted as covering all such alterations and modifications as fall within the true spirit and scope of the invention.

We claim:

1. A method for controlling the speed and steering of a watercraft according to a user-selected control mode using a plurality of transducers, a micro-controller, a steering motor, and a trolling motor, comprising the steps of:

a) initiating a user-specified control mode, wherein the control mode includes the tracking of the shore line of a body of water;

b) identifying a plurality of control mode parameters associated with said user-specified control mode, wherein the plurality of control mode parameters associated with said user-specified control mode includes the watercraft's distance from the shore at the initialization of said control mode and the current watercraft location from the shore;

c) comparing the plurality of control mode parameters associated with said user-specified control mode to determine an error index;

d) determining a steering value utilizing said error index, said steering value indicating a direction to minimize said error index;

e) determining a speed value;

f) outputting the steering value to the steering motor to steer the trolling motor to the proper direction;

g) outputting the speed value to the trolling motor for the proper speed; and h) repeating steps b)–g) a plurality of times to continuously control the steering and speed of the watercraft.

2. A method according to claim 1 wherein the plurality of control mode parameters associated with said user-specified control mode further includes the depth of the underwater terrain at the current watercraft location, and the depth of the underwater terrain at the last watercraft location.

3. A method for controlling the speed and steering of a watercraft according to a user-selected control mode using a plurality of transducers, a micro-controller, a steering motor, and a trolling motor, comprising the steps of:

a) initiating a user-specified control mode, wherein the control mode includes the tracking of the deepest portion of a body of water;

b) identifying a plurality of control mode parameters associated with said user-specified control mode, wherein the plurality of control mode parameters associated with said user-specified control mode includes port and starboard depth readings at an angle away from the current watercraft location;

c) comparing the plurality of control mode parameters associated with said user-specified control mode to determine an error index;

d) determining a steering value utilizing said error index, said steering value indicating a direction to minimize said error index;

e) determining a speed value;

f) outputting the steering value to the steering motor to steer the trolling motor to the proper direction;

g) outputting the speed value to the trolling motor for the proper speed; and h) repeating steps b)–g) a plurality of times to continuously control the steering and speed of the watercraft.

4. A method according to claim 2 or 3 whereby the step of determining a steering value further includes the step of determining a steering feedback value to reduce oversteering oscillation, said steering feedback value being utilized in the calculation of the steering value.

5. A method according to claim 4 whereby the step of determining a steering value further includes the step of increasing the steering value by a constant value to allow for a faster turn.

6. A method according to claim 5 whereby the step of determining a steering value further includes the steps of:

providing a series of steering values to execute a user-activated U-turn command; and determining the depth of water to determine the completion of the U-turn.

7. A method according to claim 6 wherein the step of determining a steering value further includes the step of changing the speed value to compensate for drift due to wind and water currents.

8. A method of controlling the speed and steering of a watercraft and following the underwater terrain at a user-specified depth using a plurality of transducers, a micro-controller, a steering motor, and a trolling motor, comprising the steps of:

a) initiating the user-specified depth;

b) determining the depth of the terrain at the current watercraft location;

c) comparing the user-specified depth and depth of the terrain at the current watercraft location to determine an error index;

d) calculating a steering value utilizing said error index, said steering value indicating a direction to minimize said error index, and wherein the step of calculating a steering value further includes the step of determining a steering feedback value to reduce oversteering oscillation, said steering feedback value being utilized in the calculation of the steering value;

e) calculating a speed value;

f) outputting the steering value to the steering motor to steer the trolling motor to the proper direction;

g) outputting the speed value to the trolling motor for the proper speed; and h) repeating steps b)–g) a plurality of times to continuously control the steering and speed of the watercraft.

9. A method according to claim 8 whereby the step of calculating a steering value further includes the step of increasing the steering value by a constant value to allow for a faster turn.

10. A method according to claim 9 whereby the step of calculating a steering value further includes the steps of:

providing a series of steering values to execute a user-activated U-turn command; and checking the depth of water to determine the completion of the U-turn.

11. A method according to claim 10 wherein the step of determining a steering value further includes the step of changing the speed value to compensate for drift due to wind and water currents.

12. A method of controlling the speed and steering of a watercraft and following the underwater terrain at a user-specified depth using a plurality of transducers, a micro-controller, a steering motor, and a trolling motor, comprising the steps of:

a) initiating the user-specified depth;

b) determining the depth of the terrain at the current watercraft location;

c) comparing the user-specified depth and depth of the terrain at the current watercraft location to determine an error index;

d) calculating a steering value utilizing said error index, said steering value indicating a direction to minimize said error index; and wherein the step of calculating a steering value further includes the step of increasing the steering value by a constant value to allow for a faster turn;

e) calculating a speed value;

f) outputting the steering value to the steering motor to steer the trolling motor to the proper direction;

g) outputting the speed value to the trolling motor for the proper speed; and h) repeating steps b)–g) a plurality of times to continuously control the steering and speed of the watercraft.

13. A method of controlling the speed and steering of a watercraft and following the underwater terrain at a user-specified depth using a plurality of transducers, a micro-controller, a steering motor, and a trolling motor, comprising the steps of:

a) initiating the user-specified depth;

b) determining the depth of the terrain at the current watercraft location;

c) comparing the user-specified depth and depth of the terrain at the current watercraft location to determine an error index;

d) calculating a steering value utilizing said error index, said steering value indicating a direction to minimize said error index, and wherein the step of calculating a steering value further includes the steps of:

providing a series of steering values to execute a user-activated U-turn command; and checking the depth of water to determine the completion of the U-turn;

e) calculating a speed value;

f) outputting the steering value to the steering motor to steer the trolling motor to the proper direction;

g) outputting the speed value to the trolling motor for the proper speed; and h) repeating steps b)–g) a plurality of times to continuously control the steering and speed of the watercraft.

14. A method of controlling the speed and steering of a watercraft and following the underwater terrain at a user-specified depth using a plurality of transducers, a micro-controller, a steering motor, and a trolling motor, comprising the steps of:

a) initiating the user-specified depth;

b) determining the depth of the terrain at the current watercraft location;

c) comparing the user-specified depth and depth of the terrain at the current watercraft location to determine an error index;

d) calculating a steering value utilizing said error index, said steering value indicating a direction to minimize said error index, and wherein the step of calculating a steering value further includes the step of changing the speed value to compensate for drift due to wind and water currents;

e) calculating a speed value;

f) outputting the steering value to the steering motor to steer the trolling motor to the proper direction;

g) outputting the speed value to the trolling motor for the proper speed; and h) repeating steps b)–g) a plurality of times to continuously control the steering and speed of the watercraft.

15. A method of controlling the speed and steering of a watercraft and following a user-specified distance from the shore using a plurality of transducers, a micro-controller, a steering motor, and a trolling motor, comprising the steps of:

a) initiating the user-specified distance from the shore;

b) determining the current watercraft distance from the shore;

c) comparing the user-specified distance and the current watercraft distance to determine an error index;

d) calculating a steering value utilizing said error index, said steering value indicating a direction to minimize said error index;

e) calculating a speed value;

f) outputting the steering value to the steering motor to steer the trolling motor to the proper direction;

g) outputting the speed value to the trolling motor for the proper speed; and h) repeating steps b)–g) a plurality of times to continuously control the steering and speed of the watercraft.

16. A method according to claim 15 whereby the comparing step further includes the step of accounting the depth of the underwater terrain at the current watercraft location, and the depth of the underwater terrain at the last watercraft location, in the calculation of the error index.

17. A method according to claim 16 whereby the step of calculating a steering value further includes the step of determining a steering feedback value to reduce oversteering oscillation, said steering feedback value being utilized in the calculation of the steering value.

18. A method of according to claim 17 whereby the step of calculating a steering value further includes the step of increasing the steering value by a constant value to allow for a faster turn.

19. A method according to claim 18 whereby the step of calculating a steering value further includes the step of:

providing a series of steering values to execute a user-activated U-turn command; and checking the depth of water to determine the completion of the U-turn.

20. A method according to claim 19 wherein the step of determining a steering value further includes the step of changing the speed value to compensate for drift due to wind and water currents.

21. A method according to claim 15 whereby the step of calculating a steering value further includes the step of determining a steering feedback value to reduce oversteering oscillation, said steering feedback value being utilized in the calculation of the steering value.

22. A method of according to claim 15 whereby the step of calculating a steering value further includes the step of increasing the steering value by a constant value to allow for a faster turn.

23. A method according to claim 15 whereby the step of calculating a steering value further includes the step of:

providing a series of steering values to execute a user-activated U-turn command; and checking the depth of water to determine the completion of the U-turn.

24. A method according to claim 15 wherein the step of determining a steering value further includes the step of changing the speed value to compensate for drift due to wind and water currents.

25. A method of controlling the speed and steering of a watercraft to the deepest area of an underwater terrain using a plurality of transducers, a micro-controller, a steering motor, and a trolling motor, comprising the steps of:

a) determining the terrain depth on the starboard side and the port side at the current watercraft location;

b) comparing the port side terrain depth and the starboard side terrain depth to determine an error index;

c) calculating a steering value utilizing said error index, the steering value indicating a direction to minimize said error index;

d) calculating a speed value;

e) outputting the steering value to the steering motor to steer the trolling motor to the proper direction;

f) outputting the speed value to the trolling motor for the proper speed; and g) repeating steps b)–g) a plurality of times to continuously control the steering and speed of the watercraft.

26. A method according to claim 25 whereby the comparing step further includes the step of accounting the change in the depth of the terrain in the calculation of said error index.

27. A method according to claim 26 whereby the step of calculating a steering value further includes the step of determining a steering feedback value to reduce oversteering oscillation, said steering feedback value being utilized in the calculation of the steering value.

28. A method of according to claim 27 whereby the step of calculating a steering value further includes the step of increasing the steering value by a constant value to allow for a faster turn.

29. A method according to claim 28 whereby the step of calculating a steering value further includes the steps of:

providing a series of steering values to execute a user-activated U-turn command; and checking the depth of water to determine the completion of the U-turn.

30. A method according to claim 29 wherein the step of determining a steering value further includes the step of changing the speed value to compensate for drift due to wind and water currents.

31. A method according to claim 25 whereby the step of calculating a steering value further includes the step of determining a steering feedback value to reduce oversteering oscillation, said steering feedback value being utilized in the calculation of the steering value.

32. A method of according to claim 25 whereby the step of calculating a steering value step further includes the step of increasing the steering value by a constant value to allow for a faster turn.

33. A method according to claim 25 whereby the step of calculating a steering value further includes the steps of:

providing a series of steering values to execute a user-activated U-turn command; and checking the depth of water to determine the completion of the U-turn.

34. A method according to claim 25 wherein the step of determining a steering value further includes the step of changing the speed value to compensate for drift due to wind and water currents.

35. An improved control system for a trolling motor comprising:

an instrumentation compartment;

a plurality of sonar transducers mounted within said instrumentation compartment in a predetermined directional configuration;

a head unit for conforming speed and direction control means, said speed and direction control means including a programmed microprocessor controller for operating a trolling motor in a plurality of control modes, and wherein said plurality of control modes include a shore tracking mode for keeping the boat at a user specified distance from the shore of a body of water;

input means for allowing user selection of at least one of the plurality of control modes; and communication means electrically connecting said speed and direction control means with said plurality of sonar transducers, said trolling motor, and said input means.

36. An improved control system for a trolling motor comprising: an instrumentation compartment;

a plurality of sonar transducers mounted within said instrumentation compartment in a predetermined directional configuration;

a head unit for conforming speed and direction control means, said speed and direction control means including a programmed microprocessor controller for operating a trolling motor in a plurality of control modes, and wherein said plurality of control modes includes a creek tracking mode for finding and keeping the boat over at the deepest area of an underwater terrain of a body of water;

input means for allowing user selection of at least one of the plurality of control modes; and communication means electrically connecting said speed and direction control means with said plurality of sonar transducers, said trolling motor, and said input means.

37. An improved control system for a trolling motor comprising:

an instrumentation compartment;

a plurality of sonar transducers mounted within said instrumentation compartment in the following predetermined directional configuration:

a transducer aiming approximately horizontally away from the starboard side of the boat;

a transducer aiming approximately horizontally away from the port side of the boat;

a transducer aiming away from the starboard side of the boat at an angle toward the bottom surface of a body of water;

a transducer aiming away from the port side of the boat at an angle toward the bottom surface of said body of water; and a transducer aiming downwardly at the bottom surface;

a head unit for conforming speed and direction control means, said speed and direction control means including a programmed microprocessor controller for operating a trolling motor in a plurality of control modes;

input means for allowing user selection of at least one of the plurality of control modes; and communication means electrically connecting said speed and direction control means with said plurality of sonar transducers, said trolling motor, and said input means.

38. An improved control system for a trolling motor comprising:

a trolling motor;

a housing for said trolling motor and including an instrumentation compartment;

a plurality of sonar transducers mounted within said compartment including the following predetermined directional configuration a transducer aiming approximately horizontally away from the starboard side of the boat, a transducer aiming approximately horizontally away from the port side of the boat, a transducer aiming away from the starboard side of the boat at an angle toward the bottom surface of a body of water, a transducer aiming away from the port side of the boat at an angle toward the bottom surface of said body of water, and a transducer aiming downwardly at the bottom surface;

a head unit for conforming speed and direction control means, said speed and direction control means including a programmed microprocessor controller for operating a plurality of control modes including a shore tracking mode for keeping the boat at a user specified distance from the shore of said body of water, a depth tracking mode for finding and keeping the boat over at a user specified depth of said body of water, and a creek tracking mode for finding and keeping the boat over at the deepest area of a underwater terrain of said body of water;

input means for allowing user selection of at least one of said plurality of control modes;

display means for showing the control mode currently operating;

a tubular shaft having a first end and a second end, the first end being attached to said head unit and the second end being attached to said trolling motor;

a hollow tubular sleeve having a first end and a middle portion, the first end of said sleeve being fixed to said head unit, wherein said sleeve fitting over said shaft and said shaft may freely rotate within said sleeve;

a mounting means have a first attachable end and a second attachable end, the first attachable end being fixed to the middle portion of said sleeve, the second attachable end for attaching said trolling motor and control system to a boat;

a steering motor for rotating said shaft within said sleeve to set the direction of the trolling motor and thereby setting the direction for the boat, said steering motor receiving commands from said speed and direction control means; and communication means electrically connecting said speed and direction control means with said plurality of sonar transducers, said trolling motor, said steering motor, said display means, and said input means.

* * * * *